US005202675A

United States Patent [19]

Tokimoto et al.

[11] Patent Number: 5,202,675

[45] Date of Patent: Apr. 13, 1993

[54] N-DIMENSIONAL SCANNING TYPE DISPLAY APPARATUS

[75] Inventors: Toyotaro Tokimoto, 23-19 Shinkamata 3-chome, Ohta-ku, Tokyo; Hiroshi Yajima, Tokyo, both of Japan

[73] Assignee: Toyotaro Tokimoto, Tokyo, Japan

[21] Appl. No.: 459,800

[22] PCT Filed: Sep. 1, 1989

[86] PCT No.: PCT/JP89/00907

§ 371 Date: May 1, 1990

§ 102(e) Date: May 1, 1990

[87] PCT Pub. No.: WO90/03022

PCT Pub. Date: Mar. 22, 1990

[30] Foreign Application Priority Data

| | | | |
|---|---|---|---|
| Sep. 2, 1988 | [JP] | Japan | 63-219950 |
| Sep. 2, 1988 | [JP] | Japan | 63-219951 |
| Feb. 15, 1989 | [JP] | Japan | 1-35844 |
| Aug. 15, 1989 | [JP] | Japan | 1-210423 |

[51] Int. Cl.[5] ..... G09G 3/32

[52] U.S. Cl. ..... 340/782; 340/755; 340/752

[58] Field of Search ..... 340/752, 754, 755, 729, 340/716, 782, 935, 936, 942; 40/369, 370, 624; 357/100

[56] References Cited

U.S. PATENT DOCUMENTS

| | | | |
|---|---|---|---|
| 3,544,958 | 9/1967 | Carey et al. | 340/936 |
| 3,585,443 | 6/1971 | Krembs | 340/752 |
| 3,636,551 | 1/1972 | Maguire | 340/752 |
| 4,160,973 | 7/1979 | Berlin, Jr. | 340/755 |
| 4,241,343 | 12/1980 | Fan et al. | 340/755 |
| 4,258,351 | 3/1981 | Shigeta et al. | 340/942 |
| 4,298,868 | 11/1981 | Spurgeon | 340/755 |
| 4,383,742 | 5/1983 | Brachet et al. | 352/100 |
| 4,470,044 | 9/1984 | Bell | 340/755 |
| 4,689,604 | 8/1987 | Sokol | 340/755 |

FOREIGN PATENT DOCUMENTS

| | | |
|---|---|---|
| 0156544 | 2/1985 | European Pat. Off. . |
| 2264652 | 8/1974 | Fed. Rep. of Germany . |
| 57185076 | 9/1976 | Japan . |
| 53122194 | 3/1977 | Japan . |
| 585782 | 6/1981 | Japan . |
| 57-195076 | 11/1982 | Japan . |
| 58-5782 | 1/1983 | Japan . |
| 6383788 | 9/1986 | Japan . |
| 62-128358 | 6/1987 | Japan . |
| 63-83788 | 4/1988 | Japan . |

OTHER PUBLICATIONS

IBM Technical Disclosure Bulletin, vol. 19, No. 5 Dec. 1976, p. 1774.

*Primary Examiner*—Jeffery A. Brier

*Attorney, Agent, or Firm*—Nils H. Ljungman and Associates

[57] ABSTRACT

An n-dimensional scanning type display apparatus, for use in a subway, tunnel, or places in which a conventional image display system may not be employed due to space limitations and/or the high moving speed of the observer, uses a display zone, a sensor zone, and a data forming zone to coordinate the display with the moving observer. The display zone is for displaying a succession of images which are responsive to moving speed information and/or moving direction information of the observer. The sensor zone is for detecting the passage of the moving observer past a reference position and is for outputting movement information, such as speed and direction to the data forming zone, which data forming zone is for forming a display changeover control signal based on the movement information.

32 Claims, 23 Drawing Sheets

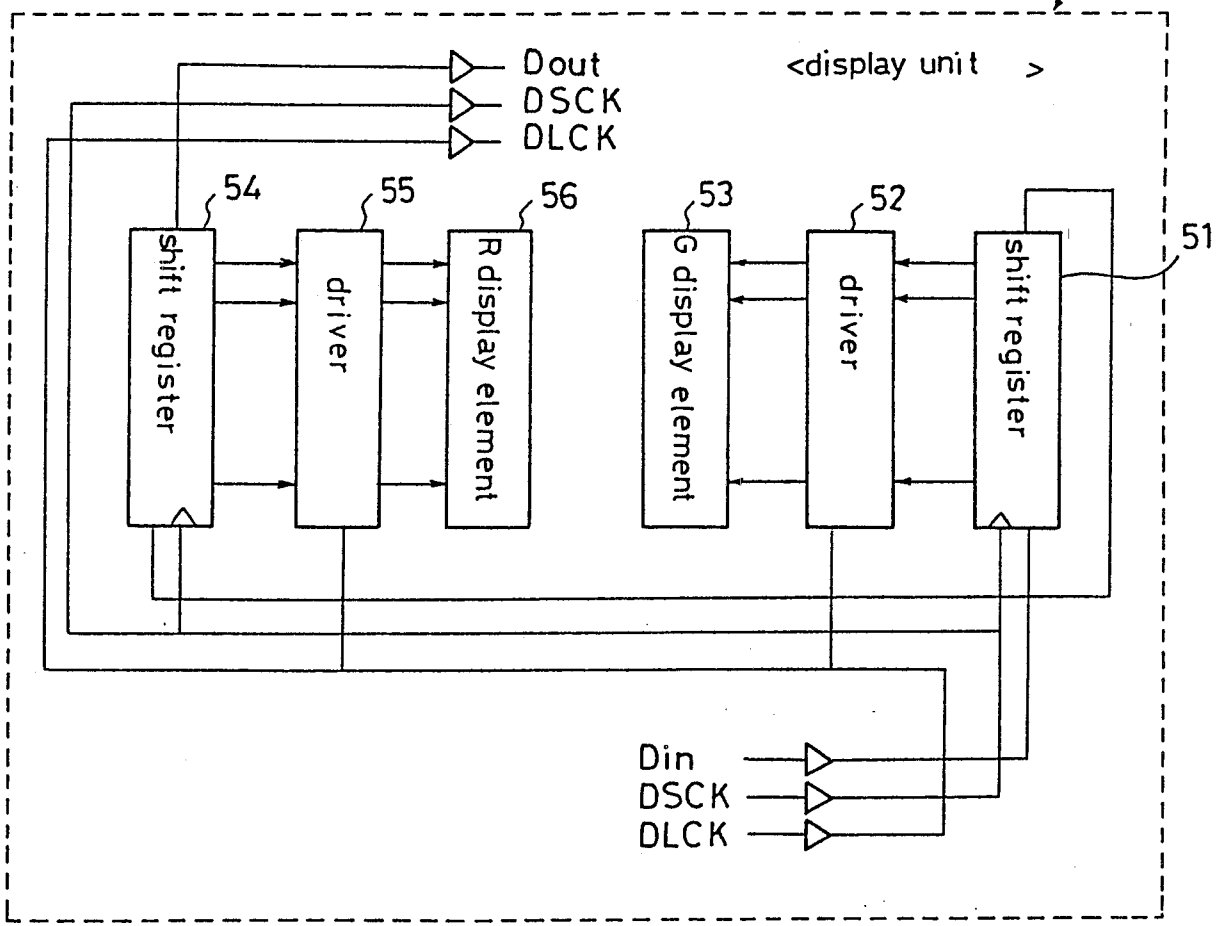
Fig. 6 - (b)
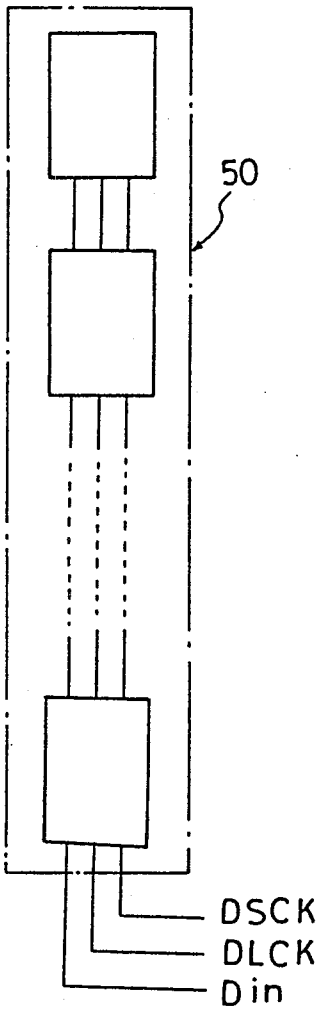
Fig. 6 - (a)

Fig.7 - (a)
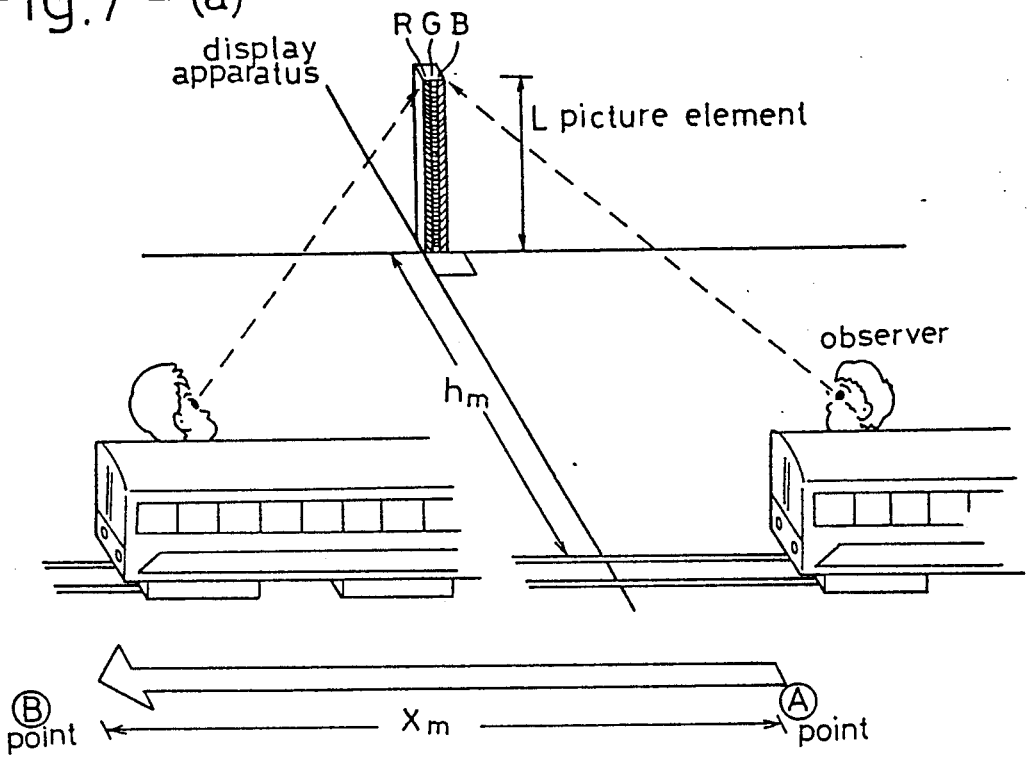
Fig.7 - (b)
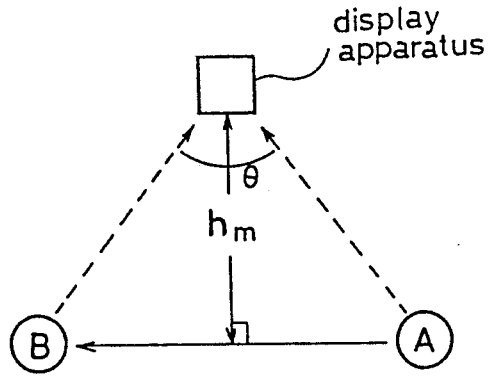
Fig. 7 - (c)
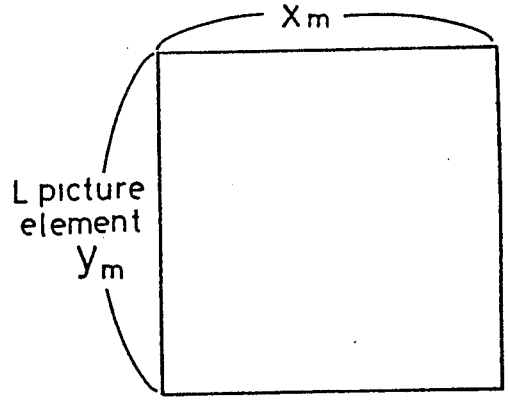

Fig.7 - (d)
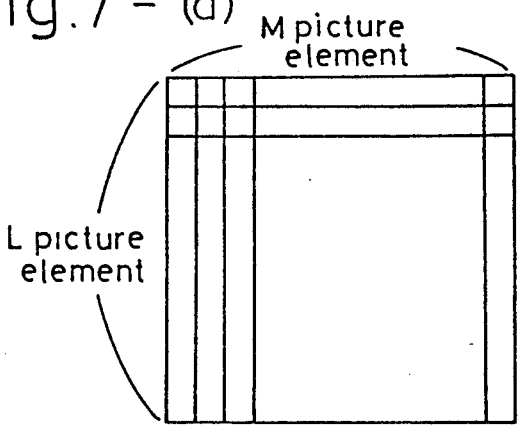
Fig.7 - (e)
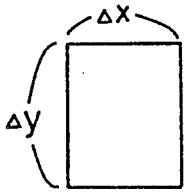
Fig.8 - (a)
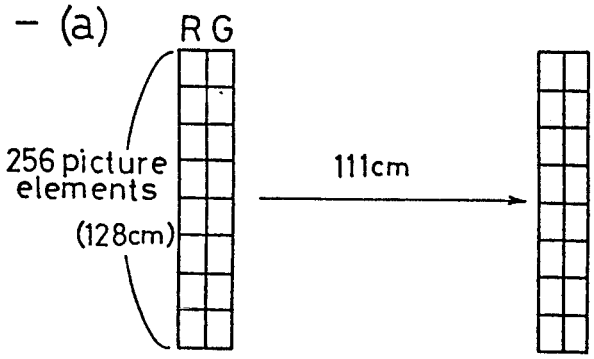
Fig.8 - (b)
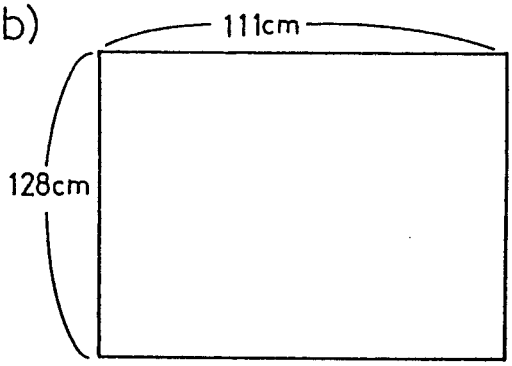
Fig.8 - (c)
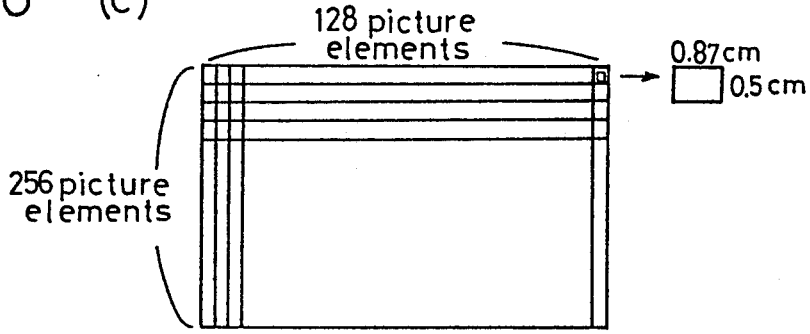

Fig.10 - (a)
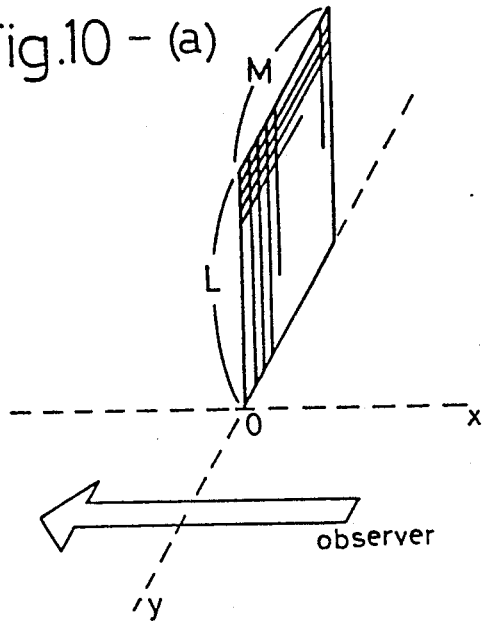
Fig.10 - (b)
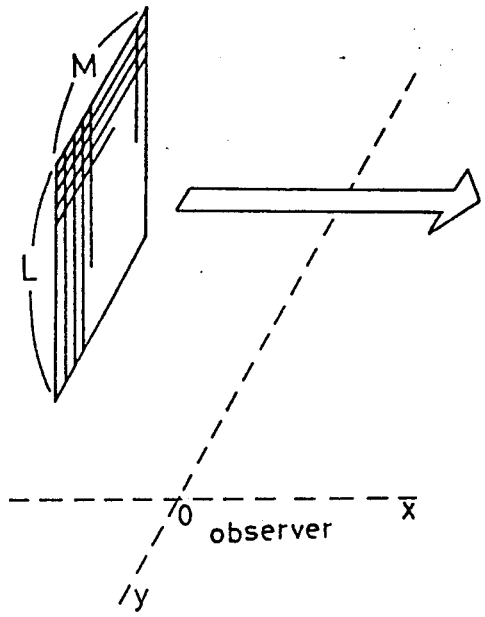
Fig.10 - (c)
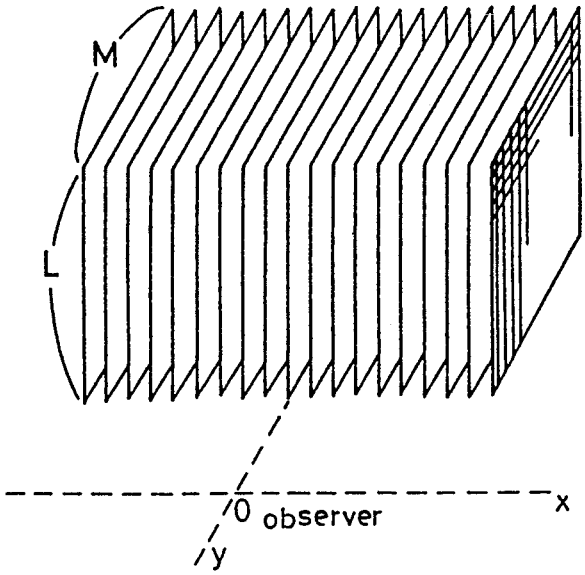

Fig.10 – (d)
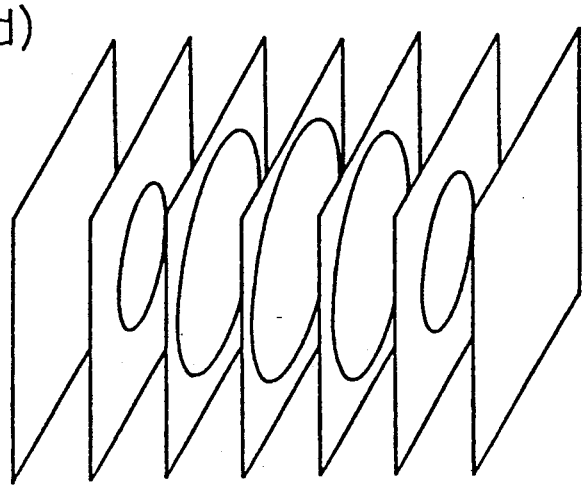
Fig.10 – (e)
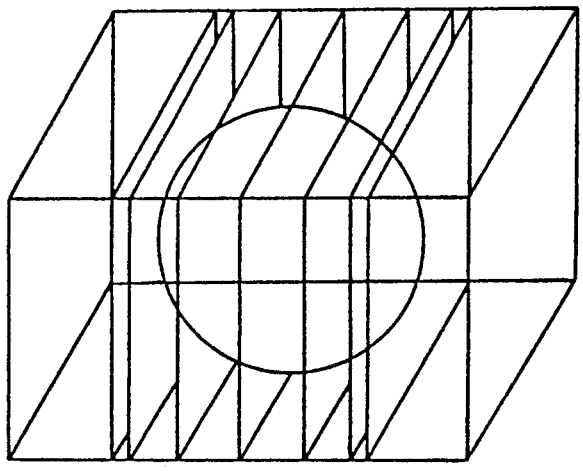
Fig.11
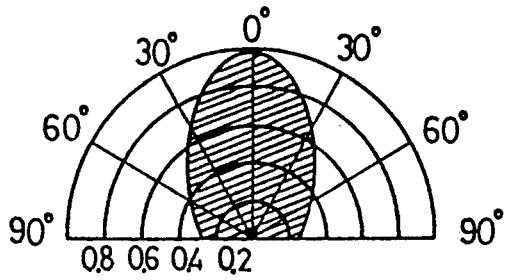

Fig. 12
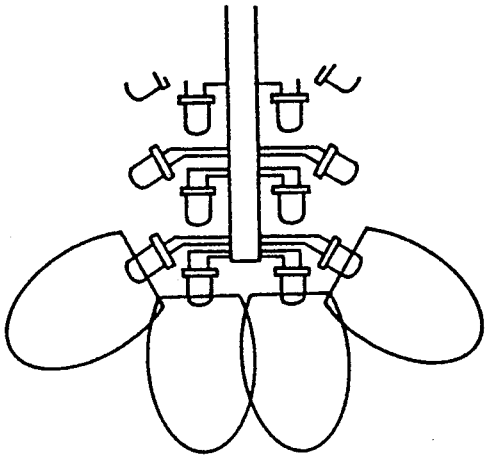
Fig. 13 – (a)
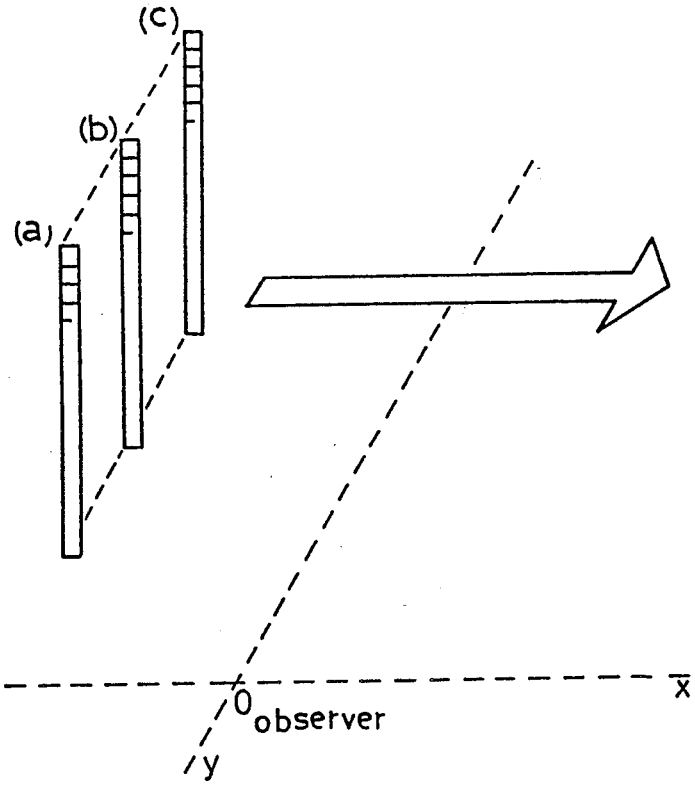

Fig.13 - (b)
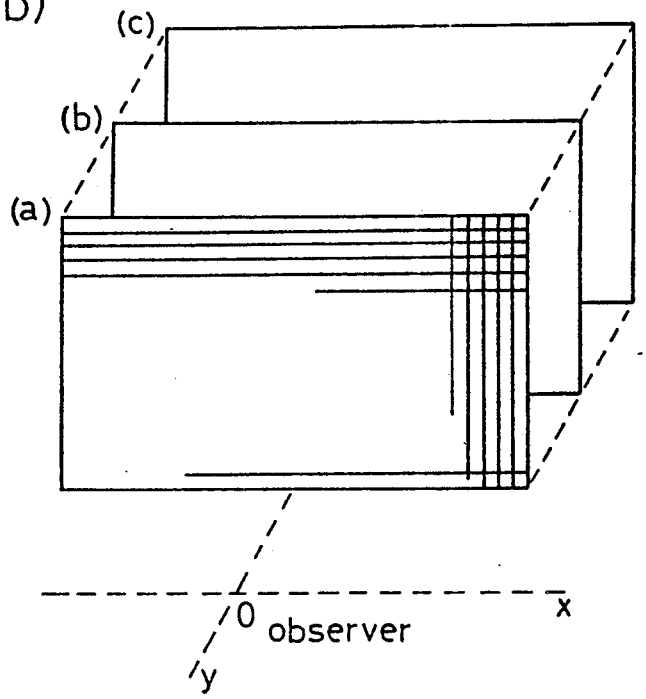
Fig.13 - (c)
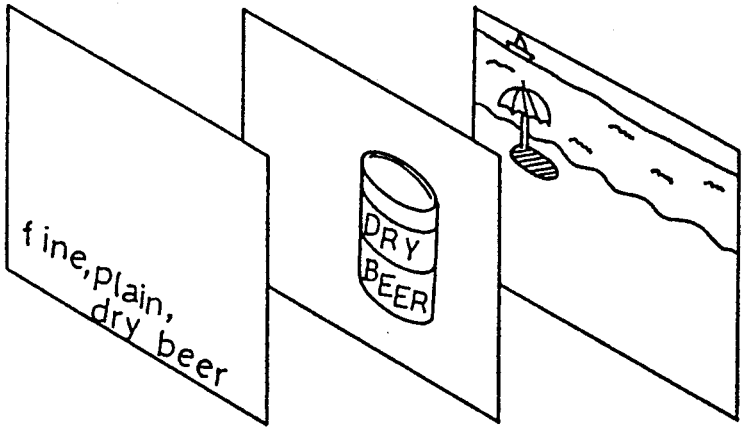
Fig.13 - (d)
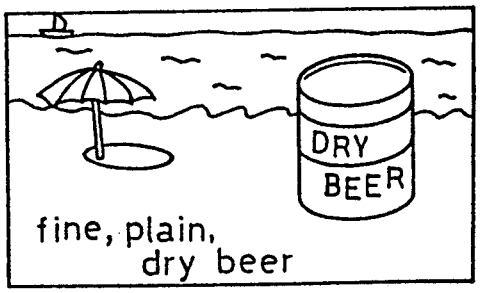

Fig.14 - (a)
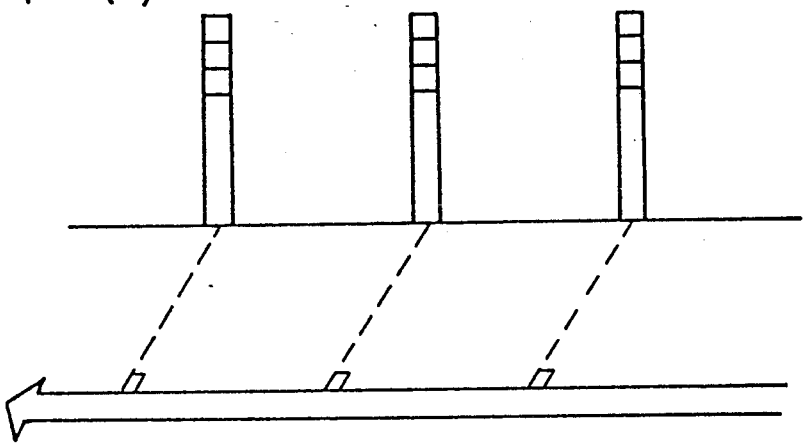
Fig.14 - (b)
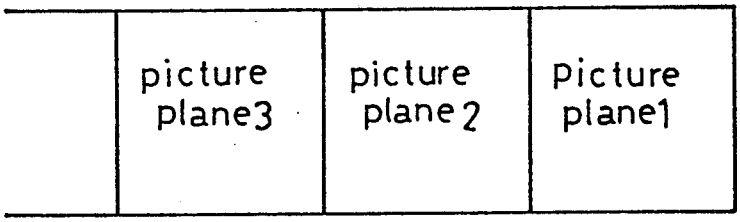

Fig.14 - (c)
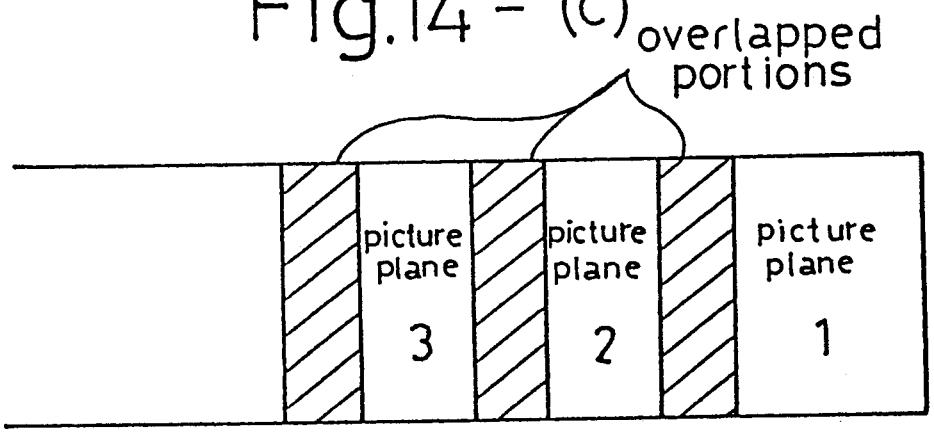
Fig.14 - (d)
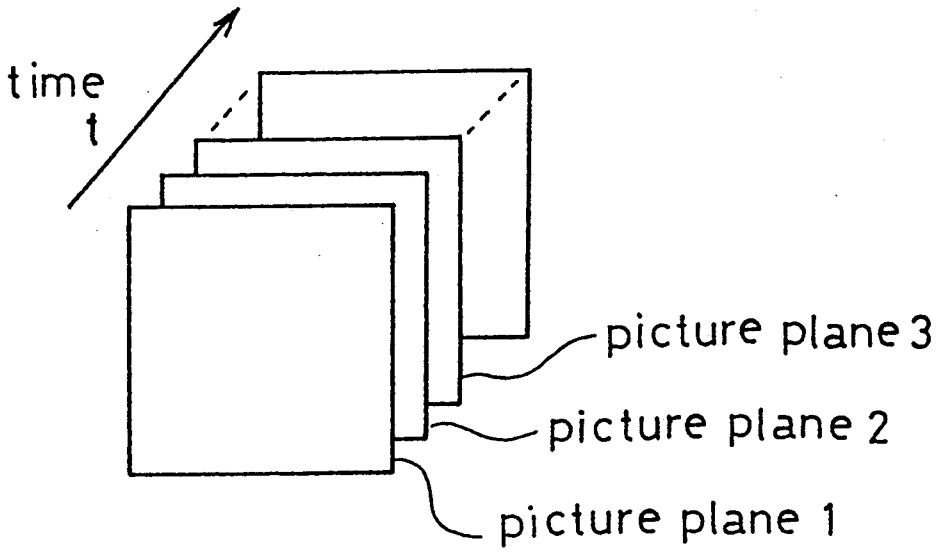

Fig.16 – (a)
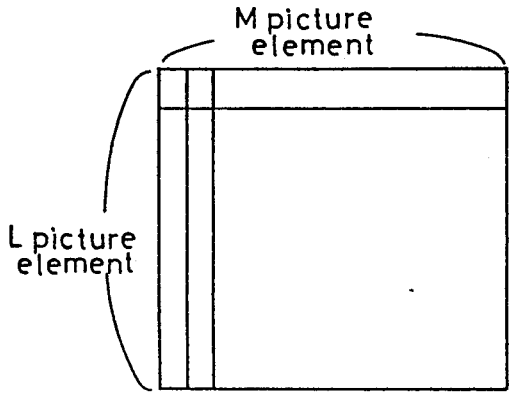
Fig.16 – (b)
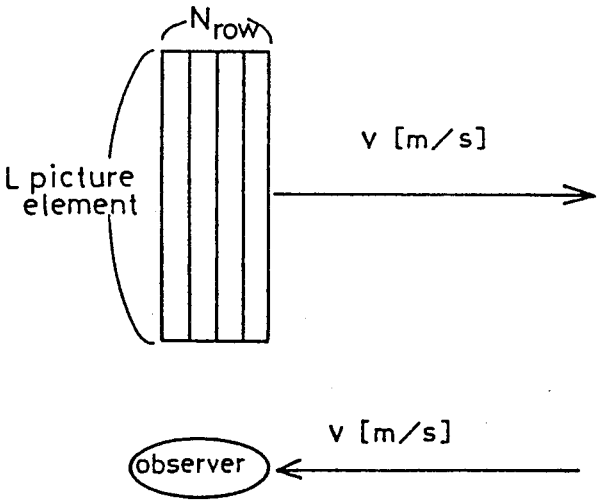
Fig.16 – (c)
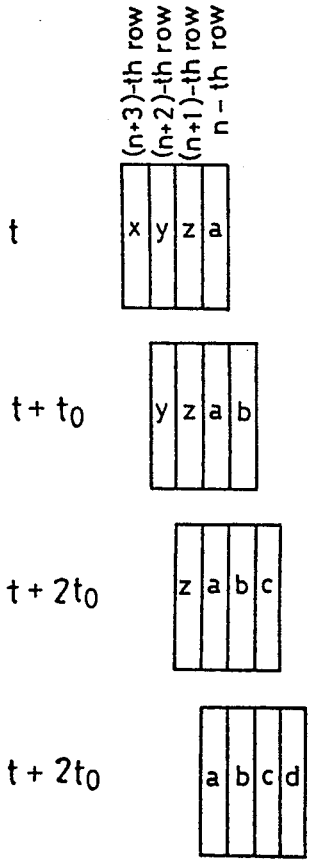

N-DIMENSIONAL SCANNING TYPE DISPLAY APPARATUS

DESCRIPTION

1. Technical Field

The present invention relates to an n-dimensional type scanning display method and apparatus, by which even an observer moving at a high speed can see the display content by utilizing the after-image effect of eyes and which can display a large image by a small number of display elements.

2. Background Art

As the conventional display method for an advertisement on a shop front or in a show window or for an outdoor advertisement, there are generally adopted a method using a signboard comprising a painted iron sheet or a cut plastic material, a method in which a box is formed in the rear of a plastic or glass sheet on which a picture is drawn and an illuminator is arranged in the box, and a method using an electric sign board comprising a neon sign or LED. Recently, there have been used an electric news or Q-vision type display system of an improved large TV, liquid crystal TV or LED type such as a jumbotron.

However, according to each of these conventional display methods, the display is mainly directed to a standing man or a man moving very slowly, and therefore, the conventional methods involve a problem in that a man moving at a high speed in the vicinity of the display apparatus cannot see the display content. With recent increase of the speed of a vehicle and recent reduction of a space for construction of an advertising tower or the like, the necessity of a display apparatus in which the display content can be correctly seen even from a moving vehicle is increasing.

In the method using a signboard or neon sign, the display content such as a displayed letter or image cannot be changed at all or can hardly be changed. In contrast, in an electric signboard or a recently developed TV type display system, the display content can be easily changed, but the mechanism is complicated.

Moreover, development of a display apparatus having an enhanced advertisement-displaying function capable of attracting the attention of an ordinary passenger more easily than in the conventional technique is desired.

Under this background, it is an object of the present invention to provide a display apparatus, in which the display content can be seen and read even by a person who is on a vehicle moving at a high speed and a large image can be displayed by a small number of display elements.

DISCLOSURE OF THE INVENTION

The n-dimensional scanning type display method of the present invention is characterized in that in obtaining an n-dimensional image in a display apparatus having an (n−1)-dimensional display plane, by the display changeover operation of the display plane and the moving operation of one of the display apparatus and the moving member for the observation, the image scanning operation in the remaining one direction is accomplished.

According to the present invention, by moving one of the display apparatus and the moving member for the observation, an n-dimensional display image can be obtained in the (n−1)-dimensional plane by utilizing the after-image effect of an observer, and an image display equivalent to the image display attained in the conventional technique can be attained by a smaller number of display elements.

The n-dimensional display apparatus of the present invention is fixedly arranged in a moving passage of the moving member for the observation, and comprises a sensor zone detecting the passage of the moving member for the observation and putting out a movement information, a data-forming zone forming a display changeover control signal based on the movement information from the sensor zone and putting out display data, and a display zone having an (n−1)-dimensional display array zone constructed by many emission elements, which is arranged for receiving display data based on the display changeover control signal from the data-forming zone and changing over and displaying (n−1)-dimensional images in regular succession.

If the scanning operation in one direction is thus performed by the displacement of the moving member for the observation and the timewise change of display data in the display apparatus, the number of display elements can be reduced, and even in a tunnel or subway where a displayed image can hardly been seen, a passenger can recognize the image clearly without moving his neck.

In the present invention, the display zone is constructed by connecting a plurality of display units, each comprising serial-parallel conversion means, display driving means and a display array zone.

By adopting this structure, the number of picture elements in the display zone can be easily increased and decreased.

Furthermore, the display array zone of the display zone is constructed to have a plurality of display array rows, the number of which is smaller than the number of display picture elements along the above-mentioned moving direction, displayed with the movement of the moving member for the observation.

In this structure, by showing the displays of respective display array rows in a time-staggering manner synchronously with the moving speed of the moving member for the observation, the image display time at a certain position seen by the observer can be prolonged by the number of the display array rows. Accordingly, the brightness level of the displayed image can be substantially elevated.

The n-dimensional scanning type display apparatus of the present invention comprises a display zone having an (n−1)-dimensional array zone, a driving zone for driving the display zone in a direction not parallel to the alignment direction of display elements of the display array zone, and a data-forming zone for forming a control signal for the changeover of the display of the display zone and putting out (n−1)-dimensional image display data for the display in the display zone.

BRIEF DESCRIPTION OF THE DRAWINGS

FIGS. 6-(*a*) and 6-(*b*) are block diagrams illustrating the structure of the display zone.

FIGS. 7-(*a*) through 7-(*e*) are diagrams illustrating the operation principle of the display apparatus of the present embodiment.

FIGS. 8-(*a*) through 8-(*c*) are diagrams illustrating the structure of one picture plane of the present embodiment.

FIGS. 10-(*a*) through 10-(*e*) are diagrams illustrating the second embodiment of the present invention, in which a three-dimensional image display is obtained by a two-dimensional image display apparatus.

FIG. 11 is a diagram illustrating the directivity characteristic of LED (display element) used as the display element.

FIG. 12 is a diagram illustrating an example in which one picture element is constructed by a plurality of LED's.

FIGS. 13(*a*)-(*d*) are diagrams illustrating the third embodiment of the present invention in which a pseudo three-dimensional image display is obtained by using a one-dimensional display apparatus.

FIGS. 14(*a*)-(*d*) are diagrams illustrating the fourth embodiment of the present invention in which a continuous image display is obtained by using a plurality of one-dimensional display apparatuses.

FIGS. 16-(*a*) through 16-(*c*) are diagrams illustrating the operation in the fifth embodiment.

EMBODIMENTS OF THE INVENTION

Embodiments of the present invention will now be described with reference to the accompanying drawings.

Figure 1:
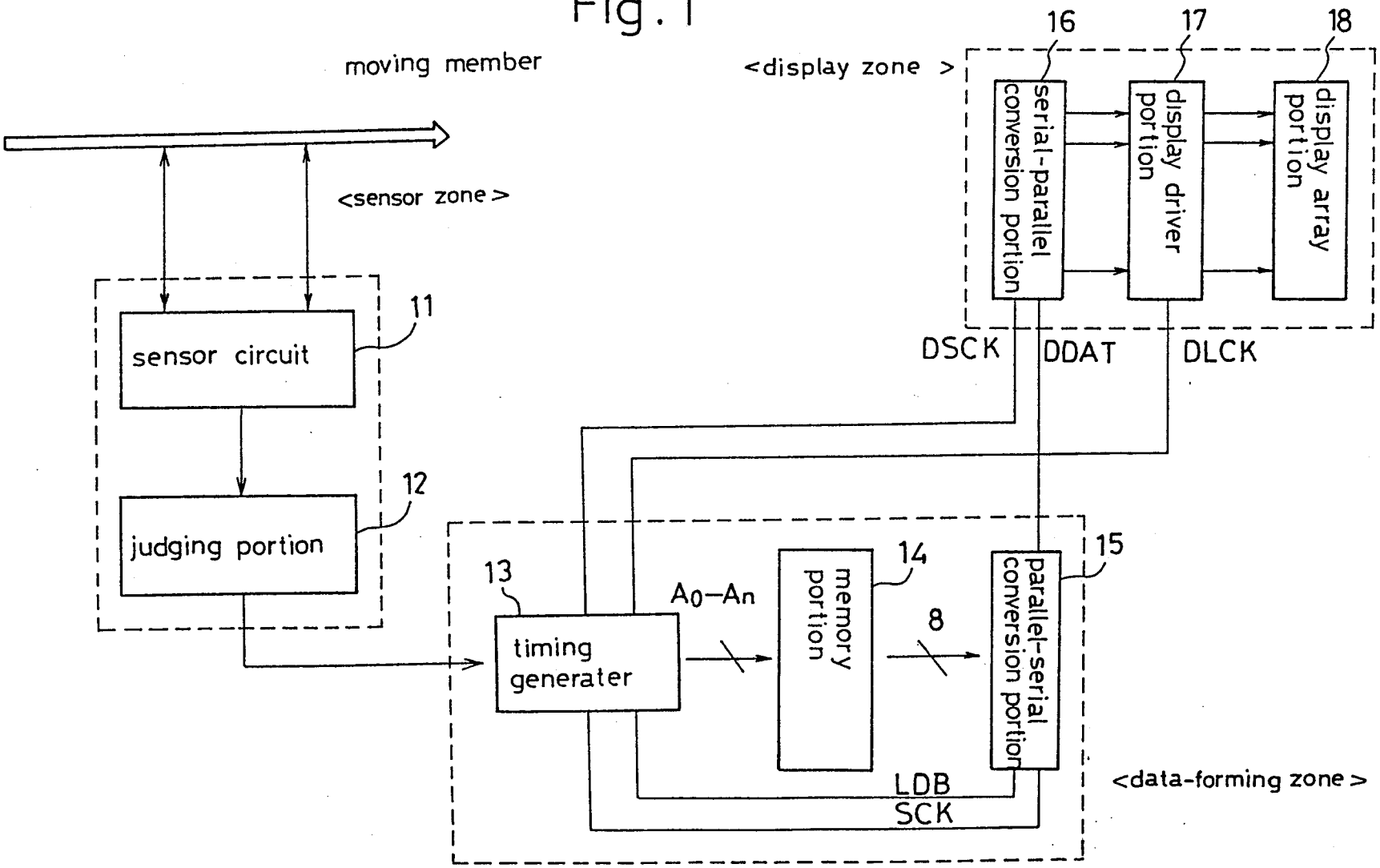
FIG. 1 is a block diagram illustrating the entire circuit structure of the first embodiment of the present invention.

FIG. 1 is a block diagram illustrating the entire structure of the first embodiment of the present invention. The entire circuit is roughly divided into three blocks of a sensor zone, a data-forming zone and a display zone. The sensor zone comprises a sensor circuit 11 for detecting the movement of a vehicle on which an observer is carried (hereinafter referred to as "moving member") and a judging portion 12 for calculating the moving direction and moving speed of the moving member on receipt of informations from the sensor circuit 11. The data-forming zone comprises a memory portion 14, a parallel-serial conversion portion 15 for converting 8-bit parallel data from the memory zone to serial data, and a timing generator 13 for forming addresses of the memory portion 14 and generating control signals for the respective zones. The display zone comprises a serial-parallel conversion portion 16 for receiving the serial data from the data-forming zone and converting them to parallel data, a display driver portion 17 for latching the parallel data and driving display elements, and a display array portion 18 comprising appropriate display elements capable of turning on and off according to a predetermined scanning speed of LED, EL or the like.

Figure 2:
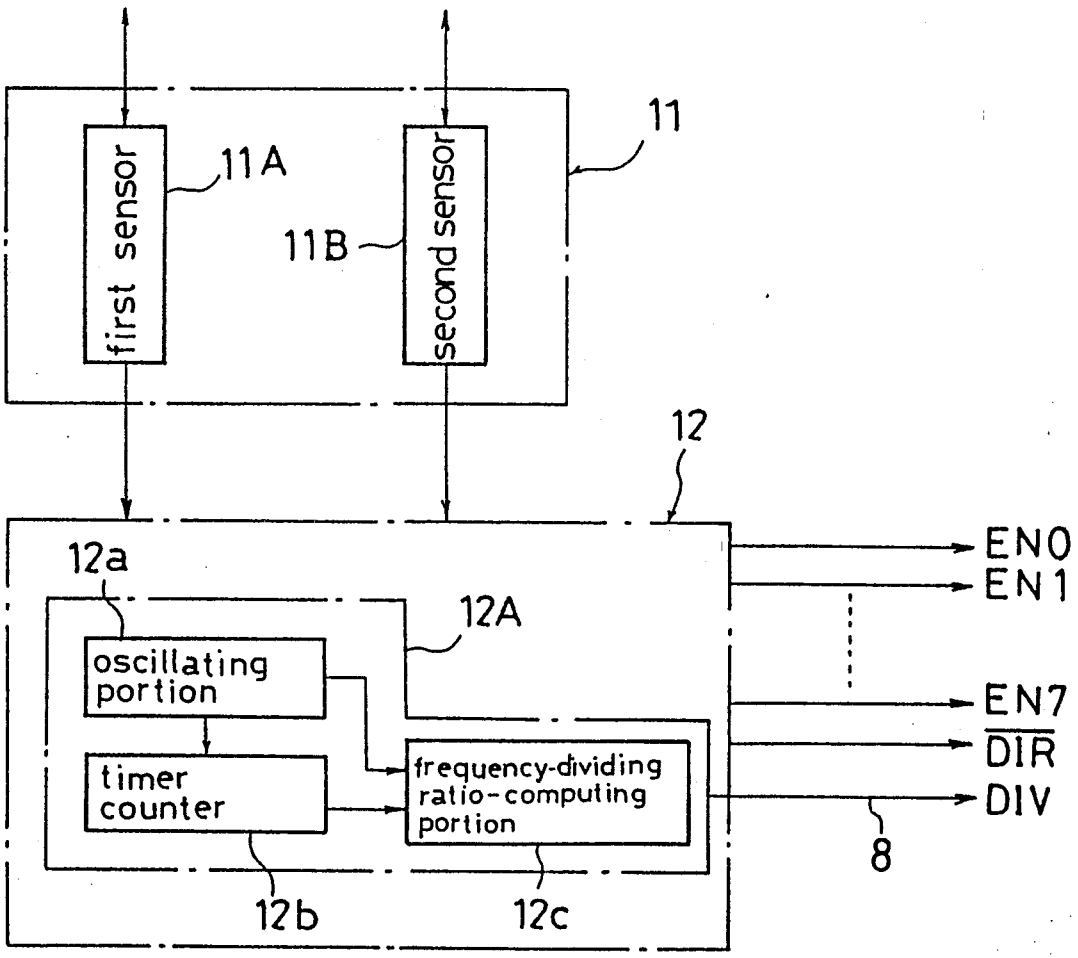
FIG. 2 is a block diagram showing the circuit structure of the sensor zone.

The sensor zone will now be described in detail with reference to FIG. 2.

Figure 3:
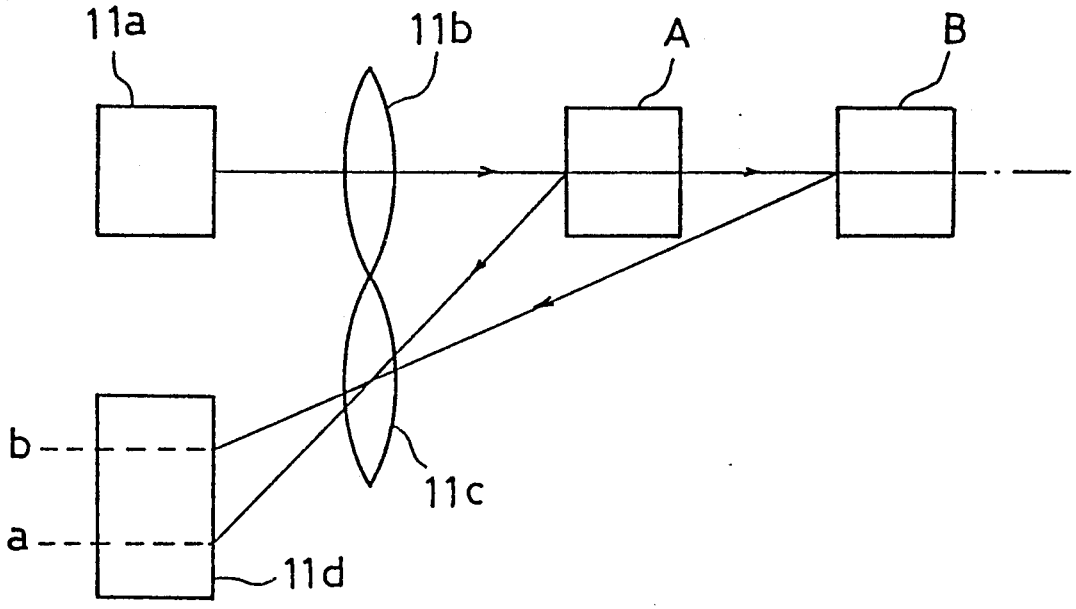
FIG. 3 is a diagram illustrating the measurement principle of the sensor.

The sensor circuit 11 comprises a first sensor 11A and a second sensor 11B arranged with a predetermined interval therebetween along the moving direction of the moving member. Each of the sensors 11A and 11B utilizes the optical triangulation method shown in FIG. 3. Namely, each sensor comprises an emitting element **11*a*, a projecting lens 11*b*, a light-receiving lens 11*c* and a position-detecting element 11*d*, and a beam from the emitting element 11*a* is converged by the projecting lens 11*d* and projected to the surface of a substance to be detected and a part of the diffused and reflected light passes through the light-receiving lens 11*c* and is detected by the position-detecting element 11*d*. Supposing that two bodies A and B are located apart from the emitting element 11*a* by different distances, the light reflected from the body located at a near position forms a spot at point a of the position-detecting element 11*d* while the light reflected from the body B located at a distant position forms a spot at point b. Accordingly, the distance to the body to be detected can be judged by detecting the spot position on the position-detecting element 11*d***.

The judging portion 12 comprises CPU equipped with an internal timer 12A including an oscillating part **12*a*, a timer counter 12*b* and a frequency-dividing ratio-computing part 12*c***.

For example, the operation conducted when an electric car approaches from the first sensor 11A will not be described.

Detection signals (supposed to be high-level signals) are put out from the first sensor 11A and second sensor 11B in this order, and it is judged that an electric car has come from the side of the first sensor 11A. When the detection output from the first sensor 11A is put into CPU 12 of the judging portion, the timer counter **12*b* of the internal timer 12A starts counting, and the counting is stopped when the detection output from the second sensor 11B is put into CPU 12. The frequency-dividing ratio is determined by the frequency-dividing ratio-computing part 12*c* based on a clock counter value from the oscillating part 12*a*, and the determined frequency-dividing ratio DIV is fed as the speed information of the electric car to the timing generator 13 of the date-forming zone. When the detection signal of the first sensor 11A disappears (low level) before the detection signal of the second sensor 11B is put into CPU 12**, it is judged that the body is not an electric car, and a start signal for the display apparatus is not put out and the counter is reset.

The value measured by the timer counter 12*b* corresponds to the time ts of the passage between both the sensors 11A and 11B. Accordingly, since the distance s between the first sensor 11A and the second sensor 11B is known, the moving speed v of the electric car can be detected by the formula of v=s/ts.

Figure 4:
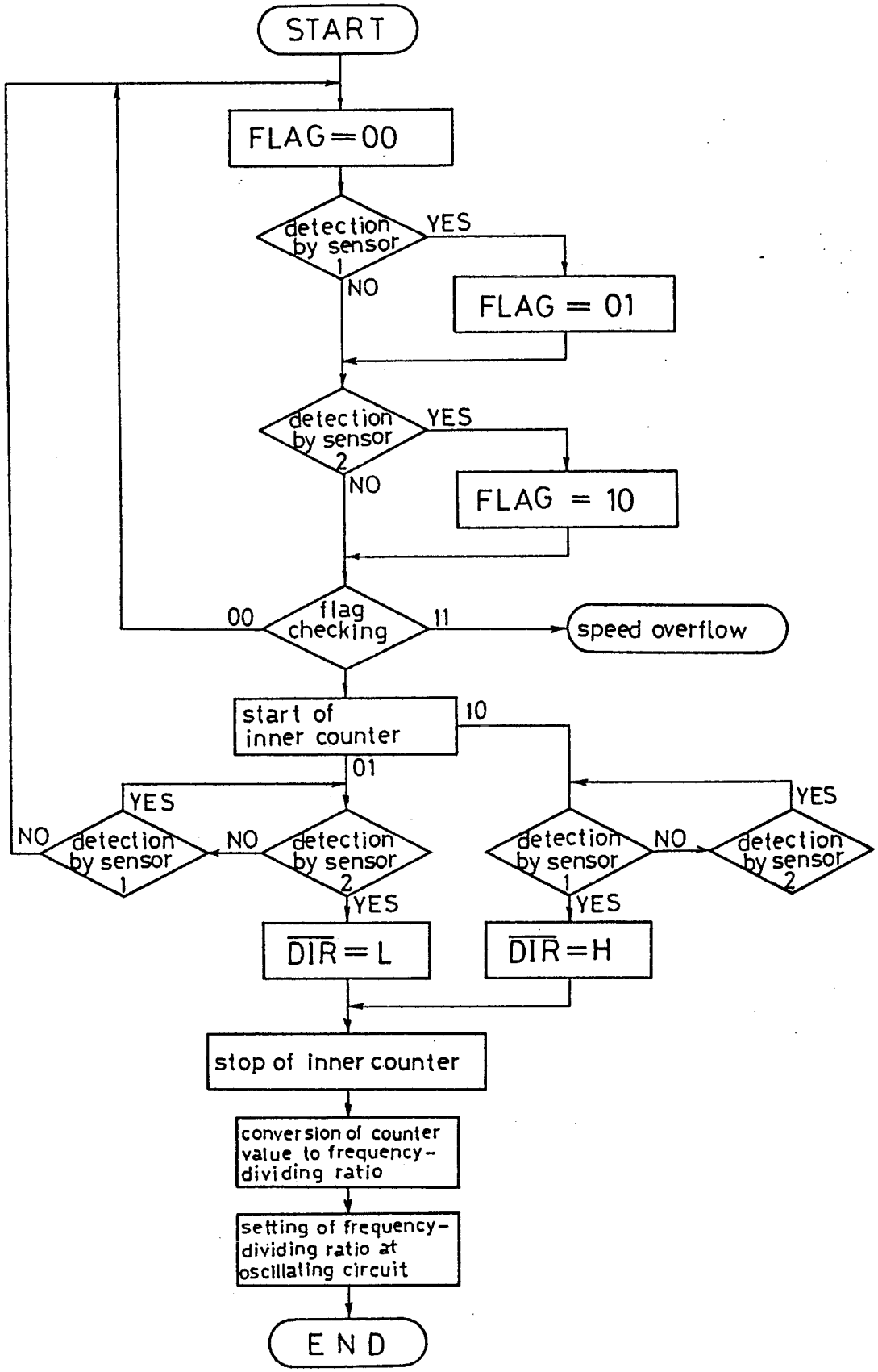
FIG. 4 is a control flow chart for judging the moving speed and moving direction of the moving member.

Supposing that the range capable of avoiding the visual field of a driver is Lm from the head of the electric car, the display device is arranged within this distance, and when a relation of l>L is established between this L and the distance l to a first window or door of the electric car for passengers from the head of the electric car, the time t1 between the point of detection of the electric car and the point of catching of the display apparatus in the visual field of a passenger is expressed as t1=l/v, and since the speed v is expressed as v=s/ts, t1 is expressed by the formula of t1=l/ts·ts. Therefore, by multiplying the time corresponding to the count value by l/s, the time between the point of detection of the electric car and the point of entrance of the display apparatus into the visual field of the passenger can be determined. Therefore, a start trigger for the display apparatus is put out after the lapse of the above-mentioned time l/s·ts from the point of detection of the electric car. In this case, the display apparatus comprises eight display units 50, and the driving timings of the respective display units 50 are controlled by enabling signals EN0 through EN7 from CPU 12. After the enabling signal EN0 is put out by the above-mentioned start trigger, the enable signals EN1 through EN7 are put out in regular succession. Supposing that the distance between every two adjacent display units is d, since the speed v of the electric car is expressed as v=s/ts, the time td of the passage through this distance d is expressed as td=d/v d/s×ts. Accordingly, with a delay time of d/s×ts from the point of the output of the start trigger of the first display signal, the start trigger for the next display unit is put out. The moving direction of the electric car is detected by judging which of the detection outputs of the first sensor 11A and second sensor 11B is first generated, as pointed out hereinbefore. The outputs of the display data should be reversed according to the moving direction of the electric car. In the present embodiment, the order to the detection outputs of the two sensors 11A and 11B is judged by CPU 12, and for example, when it is judged that the detection output is first received from the first sensor 11A, the moving direction-judging signal $\overline{DIR}$ is adjusted to a low level, and when it is judged that the detection output is first received from the second sensor 11B, the moving direction-judging signal $\overline{DIR}$ is adjusted to a high level. Thus, the line address is bit-reversed according to the output state of the moving direction-judging signal $\overline{DIR}$. Therefore, without changing the operation of the address counter, it becomes substantially possible to reverse display data and put out the reversed data, and an image display agreeing with the moving direction of the electric car can be obtained. A control flow chart for judging the moving speed and moving direction of the electric car is shown in FIG. 4.

Figure 5:
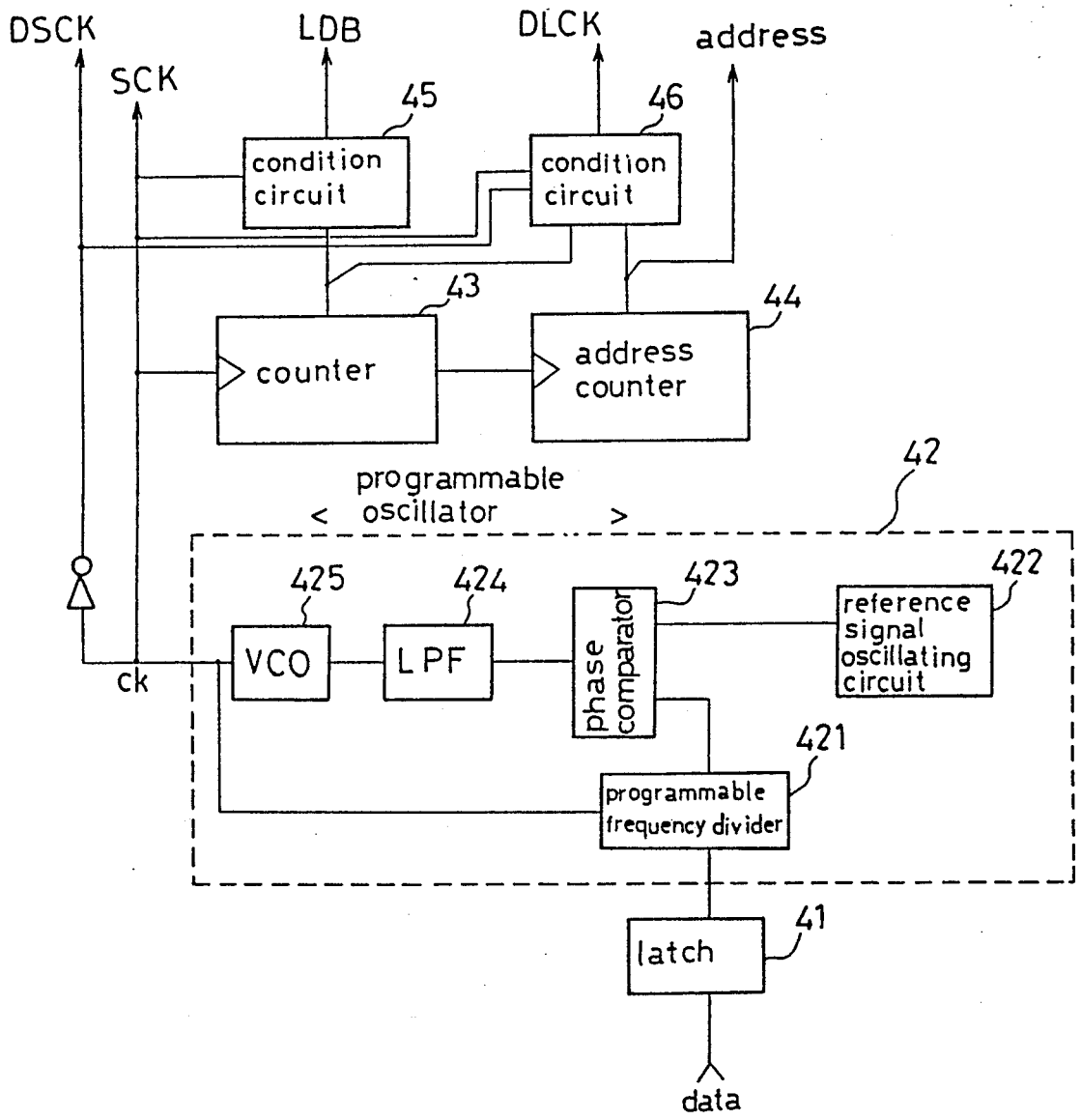
FIG. 5 is a block diagram illustrating in detail a timing generator of the data-forming zone.

The data-forming portion will now be described with reference to FIG. 5 which is a block diagram illustrating in detail the timing generator 13.

A latch 41 is a latch for storing the frequency-dividing ratio DIV obtained by decoding the speed information of the moving member, which is emitted from the judging portion 12, for the frequency divider. A programmable oscillator 42 comprises VCO 425 and a phase comparator 423 as main components for obtaining an oscillation frequency a certain progressive number of times as high as the frequency of a reference signal oscillator 422. The frequency oscillated by VCO 425 is divided at a predetermined ratio by the programmable frequency divider 421 and put into the phase comparator 423. The reference signal generated by the reference signal generator 422 is put in the phase comparator 423. The phases of the two signals are compared by the phase comparator and put out as control voltages for VCO 425 through LPF 424. Thus, a PLL circuit is constructed.

By using this programmable oscillator, an oscillation frequency which is a certain number of times as high as the frequency of the reference signal, but the intended function can also be attained by a method in which a predetermined frequency is obtained by dividing an appropriate frequency by the programmable frequency divider.

ADR-CK is prepared by a counter 43 based on the clock CK obtained by this programmable oscillator, and a load signal LDB is prepared by a condition circuit 45. The count number of an address counter 44 is increased by one, every time rising of ADR-CK is detected by an address counter of the memory portion 14. Based on the outputs of the counter 43 and address counter 44, a data clutch signal DLCK for the display driver portion 17 is prepared by a condition circuit 46. The clock CK put out from the programmable oscillator becomes a shift clock SCK of the parallel-serial conversion portion 15, and the clock formed by reversing the above-mentioned clock CK becomes a shift clock of the serial-parallel conversion portion 16. For example, with respect to the case where the speed of the moving member is 40 km/h, the display time is 100 msec, the number of picture elements is 256×128 and each picture element includes two color elements of R (red) and G (green) (each being 1-bit), since 65536 color elements (256×128×2×1 color elements) are displayed within 100 msec, it is sufficient if the clock CK of the programmable oscillator is generated at about 655 kHz. Supposing that the moving member passes at a speed of 30 km/h in the state where the oscillation frequency of the programmable oscillator is thus set, since the moving distance of the moving member for 100 msec is about 83 cm, if the scanning speed of the display apparatus is kept at the same level as adopted when the moving speed of the moving member is 40 km/h, a long display of 128 cm×83 cm with a shortened width is formed. If the moving member passes at a speed of 50 km/h, a wide display of 128 cm×139 cm is formed. Accordingly, by detecting the speed of the moving member and changing the scanning speed, the frequency of the clock CK is set at about 492 kHz when the speed of the moving member is 30 km/h or at about 818 kHz when the speed of the moving member is 50 km/h. In this case, the display time is changed to 133 msec or 80 msec, but the same display plane of 128 cm ×111 cm can be obtained.

The display zone will now be described with reference to FIGS. 6(*a*) and 6(*b*).

Since the transfer of data to the display zone from the data-forming zone is carried out in a serial manner, supposing that one display unit 50 is constructed, for example, by 8 blocks, each consisting of 32 color element dots, increase or decrease of the number of picture elements in each unit can be easily performed as shown in FIG. 6-(*a*), and every two adjacent units 50 can be sufficiently connected through three lines.

In the display unit 50, as shown in FIG. 6-(*b*), serial data put out from the parallel-serial conversion portion 15 of the data forming zone is put into a shift register 51 on the side of G, and latching and shifting are carried out by the shift clock DSCK from the timing generator 13. Then, 32 shifted data are put into a shift register 54, and similarly, 32 shifted data become outputs to the subsequent block. If data of one column are shifted to all of the units 50 (8 units in the present embodiment), the data are latched to drivers 52 and 55 by the latch clock DLCK from the timing generator 13, and instead of the data of the preceding column, the latched data are displayed at G-displaying elements 53 and R-displaying elements 56 of the display array portion 18. If the clock obtained by reversing the shift clock DSCK is put in as the latch clock DLCK, the data being shifted are displayed to effect a colorful image expression.

The principle of displaying an image by this display apparatus will now be described.

For example, the case where a two-dimensional display consisting of L×M picture elements as shown in FIG. 7-(*d*) is obtained on the display plane will now be described. In this case, each picture element comprises one color element R, one color element G and one color element B.

As shown in FIG. 7-(*a*), a one-dimensional display apparatus consisting of (L×1) picture elements is vertically arranged, and the moving member moves at a speed of $X_o$ m/sec at a point apart from the display apparatus by a vertical distance of $n_m$. The value h is determined by the angle of the visual field of the observer and the display area. FIG. 7-(*b*) is a plane view of FIG. 7-(*a*).

Supposing that the display time of one image plane is t msec, the observer moves by $x_m$ for t msec, as shown by the equation of $x=(x_0 \times t)/1000$.

At this point, to the observer, it seems that the display apparatus moves relatively by $x_m$ FIG. 7-(*c*) . If new data are displayed at every t/M msec on the one-dimensional display apparatus, a display of (L×M) picture elements can be obtained FIG. 7-(*d*) . Supposing that the size of the picture element is of $\Delta y \times \Delta x$ as shown in FIG. 7-(*e*), $\Delta y$ is determined by the interval between the display elements of the one-dimensional display apparatus, and $\Delta x$ is determined by the moving speed of the observer and the display changeover speed.

Incidentally, if the observer chases the display apparatus with his own eyes, the display area is smaller than $x_m$. The reason is that the display area changes relatively to the angle of the visual field of the observer. Accordingly, there is a mutual relationship between the moving speed of the observer and the distance h to the display apparatus.

The relationship between the moving speed of the observer and the distance h to the display apparatus will now be described.

The speed of movement that can be visually detected by a man is (1) 15°/sec when the eyes are fixed or (2) 25° to 30°/sec when the eyes are moved along with the moving object, and (3) the upper limit speed of movement that can be visually detected beyond which only a light band is observed) is 50°/sec.

Thus, visual detection of a moving body is defined by the angular speed, and in FIG. 7-(*b*), the relation of the distance x between A and B to the distance h is expressed by the equation of $x=2\ h \cdot \tan \theta/2$. That is, a proportional relation is established between h and x.

Accordingly, in order to obtain a desirable image scanning operation, it is necessary that the moving speed of the moving member should be increased with increase of the distance h between the display apparatus and the moving member.

The case where a two-dimensional display is obtained by the apparatus of the present embodiment utilizing the above-mentioned display principle will now be described.

In this case, the LED display pigment has one chip R and one chip G installed therein, and hence, the explanation will be made based on the supposition that one picture element comprises two color elements R and G and makes one-bit display.

Referring to FIGS. 8(*a*)-(*c*), the observer sees the display zone having a length of about 128 cm and comprising (256×1) picture elements from the moving member. Supposing that the moving member moves at a speed of 40 km/h toward the left in the drawings, to the observer, it seems that the display zone relatively moves as shown in FIG. 8-(*a*). Supposing that the the display time is 100 msec, the display zone moves to the right by about 111 cm during this display time as shown below:

$$111 \approx \frac{40 \times 1000 \times 100}{60 \times 60 \times 10}$$

Namely, a display of 128 cm×111 cm can be obtained for 100 msec FIG. 8-(*b*) . If data of the display zone are changed over at an interval of 78 μsec, a display of (256×128) picture elements can be obtained because of 78 μsec 100 mse/128, as shown in FIG. 8-(*c*).

Figure 9:
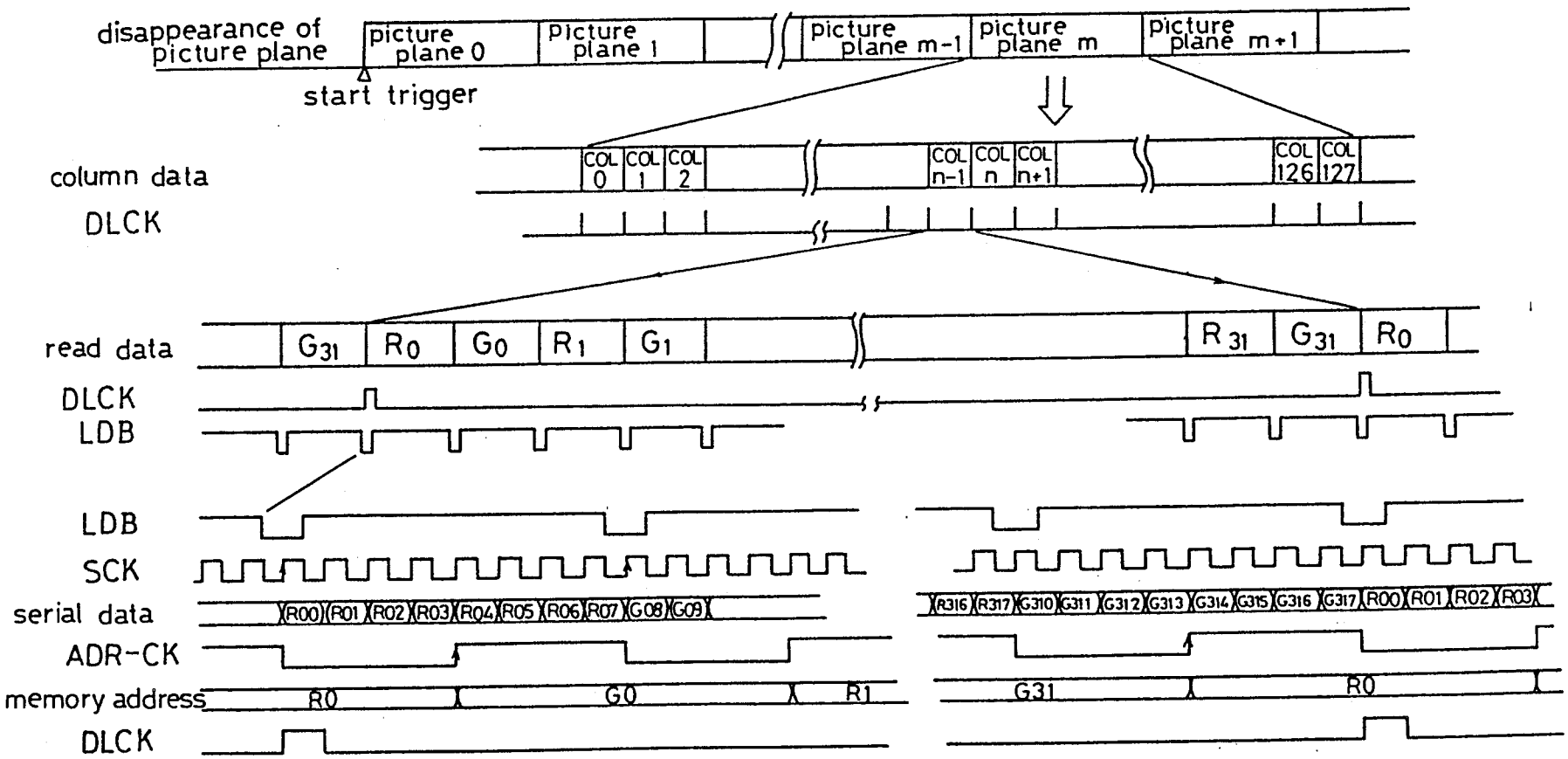
FIG. 9 is a timing chart illustrating the operation of the present embodiment.

The flow of data in the above-mentioned example will now be described with reference to the timing chart of FIG. 9.

When the moving member passes through the sensor zone, the sensor circuit 11 detects this movement, and based on this detection information, the judging portion 12 detects the moving direction and moving speed to give the decoded data and start trigger to the data-forming zone. Picture plane data are read out from the data-forming in succession, and picture planes O, . . . M, . . . are displayed as shown in the timing chart. In this case, the picture plane data of one frame comprises 128 rows of column data. Data of one column comprises 32 each of read data R and G of the memory portion 14 having the 8-bit structure. The read data are transferred as serial data to the display portion from the data-forming portion.

More specifically, when decoded data (frequency-dividing ratio data DIV) are put into the latch 41 of the timing generator 13 at a speed of 40 km/h from the sensor zone, as pointed out hereinbefore, the oscillation frequency of the programmable oscillator is set at 655 kHz based on the above data to generate clock CK. The output timings of address clock ADR-CK determining the address-forming timing of the memory portion 14, load signal LDB determining the data load timing within the memory portion 14, shift clock SCK determining the data transfer timing from the parallel-serial conversion portion 15, shift clock DSCK determining the data load timing of the serial-parallel conversion portion 16 and data latch clock DLCK determining the data latch timing of the display driver portion 17 are determined by the timing generator 13 based on this frequency of 655 kHz, and these clocks are put out at the predetermined timings.

The address within the memory portion 14 is designated by a signal from the address counter 44 in which the count number is increased by one at every rising of the address clock ADR-CK. Read data of 8 bits in the designated memory address are loaded as parallel data in the parallel-serial conversion portion 15 at the rising of the shift clock SCK when the load signal LDN is at a low level. Then, at every subsequent rising of shift clock SCK, the data are transferred as serial data from the parallel-serial conversion portion 15 to the serial-parallel conversion portion 16 and taken into the serial-parallel portion 16 at every rising of shift clock DSK which is the reversion clock of shift clock SCK. When data of 256 bits each of R and G are completely shifted to the display zone consisting of 8 display units in the above-mentioned manner, the above-mentioned data are latched in the display driver portion 17 by latch clock DLCK from the timing generator 13 and are displayed as column data COLn of one column in the display array portion 18. Simultaneously, transfer of subsequent column data is started. If 128 column data are thus transferred, an image plane having a size of 128 cm×111 cm, which is constructed by (256×128) picture elements, is displayed.

If the display apparatus having the above-mentioned structure is used, the display apparatus can be arranged at a position where the conventional display apparatus cannot be arranged because the distance between the observer and the wall surface is too narrow as in a subway or a tunnel and the display content cannot be read because of the movement of the observer. Furthermore, the size of the display picture plane can be simply changed based on the moving speed of the observer by electronic scanning. Still further, since an n-dimensional picture plane can be obtained by the (n−1)-dimensional display apparatus, the number of display elements can be remarkably reduced as compared with the number of display elements in the conventional technique, and therefore, the structure of the apparatus can be simplified.

Incidentally, there can be adopted a modification in which three sensors are arranged, and when there is caused a change of the speed, the acceleration at this speed change is computed and the display changeover speed is corrected according to the change of the speed.

In the foregoing embodiment, the two-dimensional image display is illustrated, but the three-dimensional display can be effected.

FIGS. 10(*a*)–(*e*) are diagrams illustrating the operation of the second embodiment in which the three-dimensional image display is effected. The display portion shown in FIG. 1 is formed as a display plane of (L×M) picture elements, different from the one-dimensional display portion. When the moving member passes to the left in the drawings as shown in FIG. 10-(*a*), the display portion is seen by the observer to move toward the right FIG. 10-(*b*) . Accordingly, although the data quantity increases, the data from the data-forming portion as shown in FIG. 1 are changed at the changeover speed set according to the moving speed of the moving member, whereby a steric display of (L×M×N) picture elements as shown in FIG. 10-(*c*) is obtained.

This embodiment will now be described with reference to the display of a sphere as an example. As shown in FIG. 10(*d*), slice data of the sphere are transferred in succession to the two-dimensional display portion. At this point, slice data of the sphere can be fed out at predetermined intervals as shown in FIG. 10-(*d*), or slice data can be transferred at different feed timings as shown in FIG. 10-(*e*). As the feed timings of the transfer of data is made finer, a display image of a smoother sphere is obtained.

In the case where LED is used as the display element, the directivity characteristic of the LED element is as shown in FIG. 11, and it sometimes happens that the angle of the visual field is considerably restricted. In this case, as illustrated in FIG. in order to expand the display area, several LED elements are arranged and set in different directions to effect the display of one picture element. By this arrangement, the visual field angle can be effectively expanded.

FIGS. 13(*a*-(*d*) illustrate the third embodiment in which a plurality of one-dimensional display apparatuses are arranged in the depth direction to effect pseudo three-dimensional display.

In the case where three one-dimensional apparatuses are arranged and the moving member moves from the right to the left in the drawings as shown in FIG. 13-(*a*), the display apparatuses shown in FIG. 13-(*a*) move relatively to the right and they are seen to be three planes having a depth by the observer on the moving member as shown in FIG. 13-(*b*). For example, a background is shown in the deepest plane (c), a commodity or person is shown in the second plane (b) and a tradename or an article to be especially emphasized is shown in the front plane (a), as shown in FIG. 13-(*c*). An impressive advertisement display having a deepness, as shown in FIG. 13-(*d*), is obtained.

FIGS. 14(*a*)-(*d*) show the fourth embodiment in which one-dimensional display apparatuses are arranged in the direction of the advance of moving member. In the case where the moving member moves from the right to the left in the drawings as shown in FIG. 14-(*a*), if the space between two adjacent one-dimensional display apparatuses is appropriately set, a continuous long display of picture planes 1, 2, 3, . . . as shown in FIG. 14-(*b*) or a discontinuous frame-to-frame display as shown in FIG. 14-(*c*) can be obtained. For example, when the speed of the moving member is 16.7 m/sec and the display time is 1/30 sec, a continuous display can be obtained if the display apparatuses are arranged at intervals of about 56 cm. Of course, when a discontinuous frame-to-frame display as shown in FIG. 14-(*c*) is obtained, it is not necessary to arrange the display apparatuses as adjacently to one another as mentioned above.

Furthermore, there can be adopted a method in which overlapped portions as shown in FIG. 14-(*d*) are formed in view of the movement of eyes, and a method in which a plurality of display apparatuses are arranged so as to cope with the change of the speed of the moving member and the display apparatuses are changed over based on the detected data of the speed.

The fifth embodiment of the present invention will now be described.

The entire structure of this embodiment is similar to that of the first embodiment shown in FIG. 1, but in the present embodiment, in the display zone, a plurality of rows of display elements are arranged to form a display array portion 18.

Figure 15:
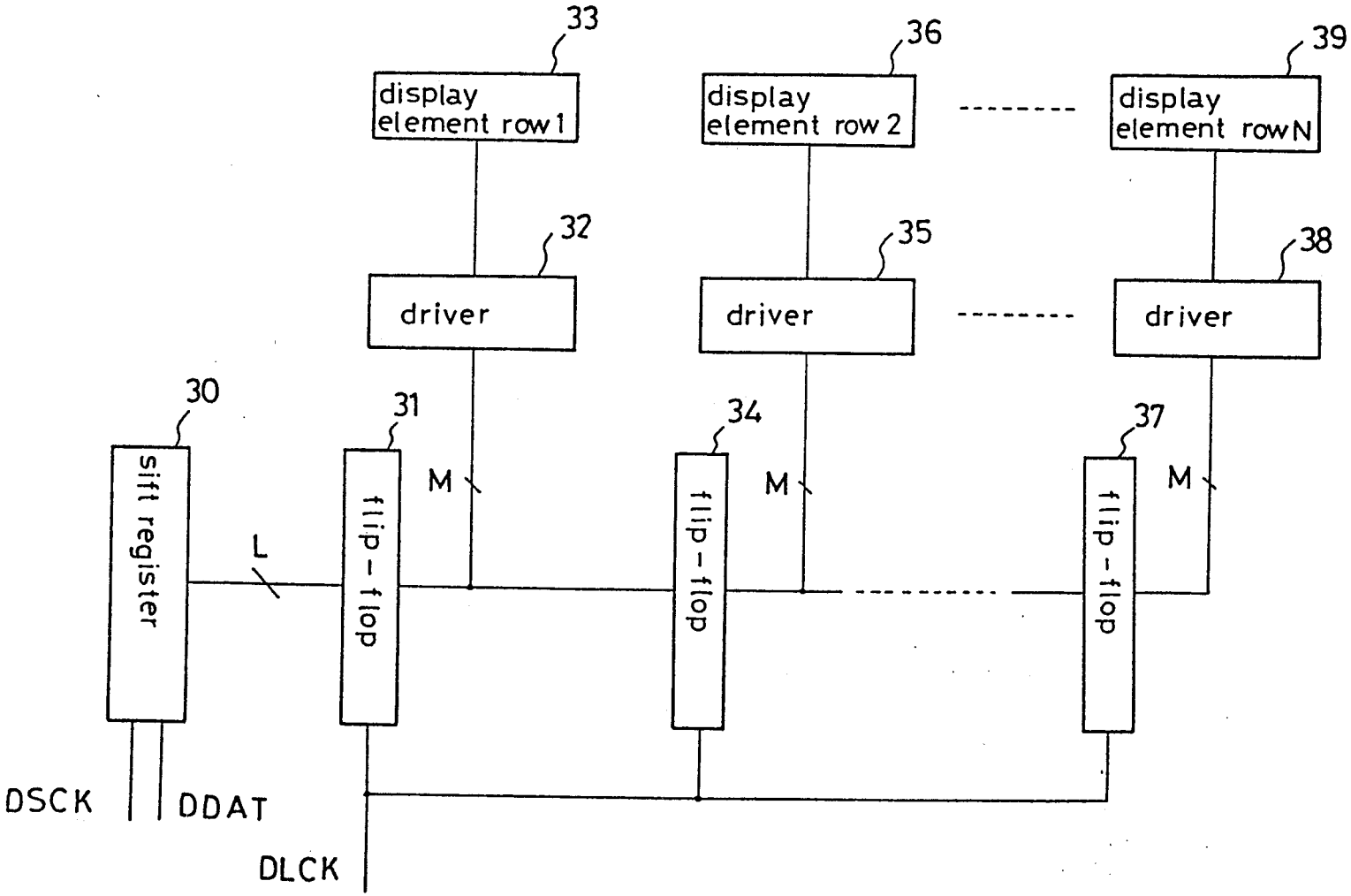
FIG. 15 is a block diagram showing one example of the circuit structure of the display zone in the display apparatus of the fifth embodiment having a plurality of display element rows.

Referring to FIG. 15, N (N=1, 2, . . . ) of display element rows 33, 36, . . . 39 are arranged in the display zone, and N of drivers 32, 35, . . . 38 and N of flip-flop circuits (hereinafter referred to as "F/F") 31, 34, 37 are connected to corresponding display element rows. A shift register 30 for receiving serial data from the data-forming zone is connected to F/F 31 of the first stage.

The function will now be described with reference to FIGS. 16(*a*)-(*c*).

For simplification of illustration, the case where a two-dimensional display plane is obtained will now be described. For example, in case of a display picture plane consisting of (L×M) picture elements as shown in FIG. 16(*a*), supposing that the length-breadth ratio is 1/1, if the element interval in L picture elements is d (mm), the display interval in M elements is d. Supposing that, the passing speed of the observer is v (m/s), the time $t_o$ of the display interval is expressed by the formula of $t_o = v/d$. Hereinafter, this to will be referred to as "unit time".

In the above-mentioned scanning display apparatus, the display data are renewed at intervals $t_o$, and by the after-image effect in eyes, a display picture plane of (L×M) picture elements can be obtained. In the present embodiment, in each row of display apparatuses comprising a plurality (N) of display element rows, as in the foregoing embodiments, display data are renewed at intervals of $t_o$, and by feeding display data to the adjacent row of display elements at intervals of $t_o$, the display time for data of one row becomes N times and the brightness level is increased.

More specifically, in the case where the observer passes to the left at a speed of v (m/s) as shown in FIG. 16-(*b*), the fixed display apparatus is seen to move at a speed of v (m/s) to the right by the observer. Referring to FIG. 16-(*c*), display data on the n-th row at time t are data a, and at time $(t+t_o)$ after the passage of the unit time, new display data b are displayed on the n-th row and data a are displayed on the (n+1)-th row. Since the observer moves by the element interval d during this period, it seems to the observer that data a are displayed at one position for a time two times as long as in the conventional apparatus. Then, display data are transferred to adjacent rows in succession, and therefore, a display time N times as long as the display time in the conventional technique can be obtained and the brightness level can be substantially increased.

Of course, N can be determined according to the desired brightness level, and needless to say, N can be determined irrespectively of the number M of picture elements in the lateral direction.

The operation in the display zone in the present embodiment will now be described. Data DDTA of one column read in the shift register 30 by shift clock DSCK set according to the moving speed of the moving member are latched at F/F 31 by latch clock DLCK generated at every unit time to, and the display element row 33 is driven by the display driver 32 to display data DDAT. Data of F/F 31 at preceding one timing are latched at F/F 34 and are displayed on the display element row 36 through the driver 36. Namely, referring to FIG. 16-(*c*), display data a on the n-th row at timing t are displayed as data of (n+1)-th row at timing $(t+t_o)$. Similarly, data latched at N-th F/F 37 are displayed by the display element row 39 through the driver 38. As pointed out hereinbefore, the moment the column data are latched at the adjacent column, data a are seen to stand stationary because the passenger on the moving member moves by the same distance as the display element row interval. Accordingly, data a can be displayed for a time N times as long as the display time in case of one display row.

Figure 17:
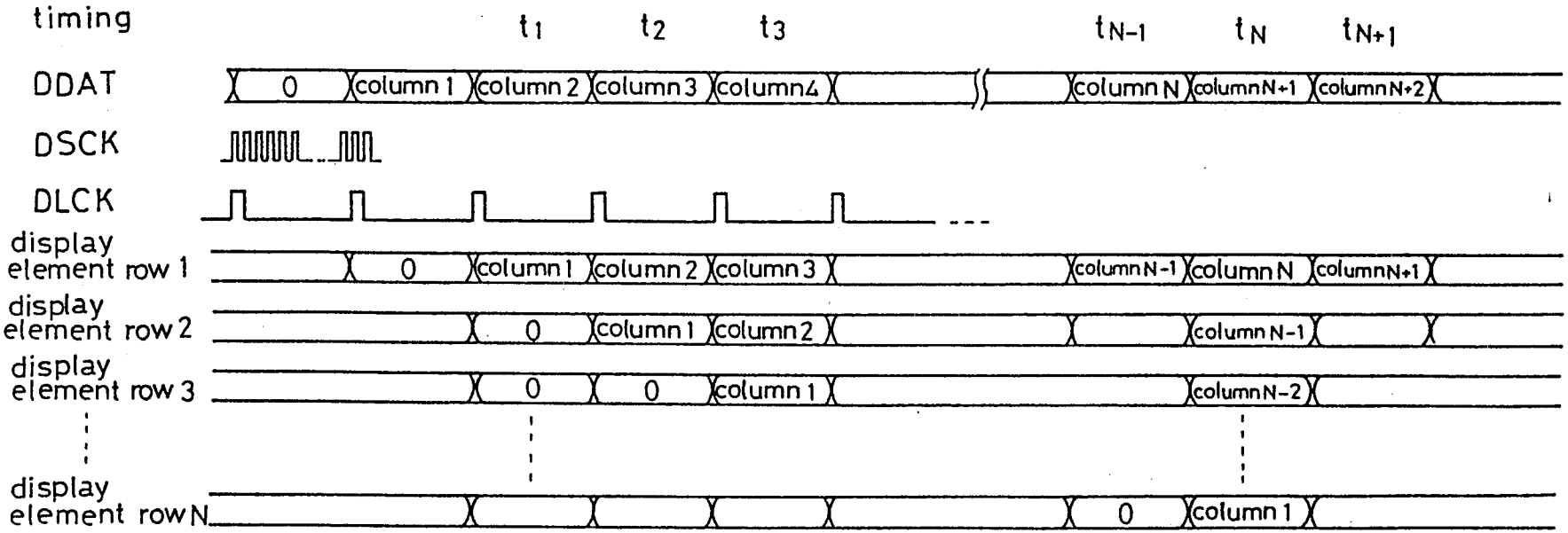
FIG. 17 is a timing chart illustrating the operation of the fifth embodiment.

A timing chart of the data transfer is shown in FIG. 17. It is now assumed that the display starts from column 1 of display data DDTA and preceding data are zero. Data DDTA transferred to the shift register 30 by shift clock DSCK are latched at F/F 31 by latch clock FLCK, but at timing $t_1$, only the display element row 33 displays the data of column 1 but the display disappears at other display elements because data of zero are latched by F/F. At timing $t_2$, the data of column 1 are latched at F/F 34 and the data of column 2 are latched at F/F 31. Therefore, column data 2 are displayed on the display element row 33 and column data 1 are displayed on the display element row 34. Similarly, at timing $t_3$, data of column 3 are displayed on the display element row 1, data of column 2 are displayed on the display element row 2 and data of column 1 are displayed on the display element row 3.

Figure 18:
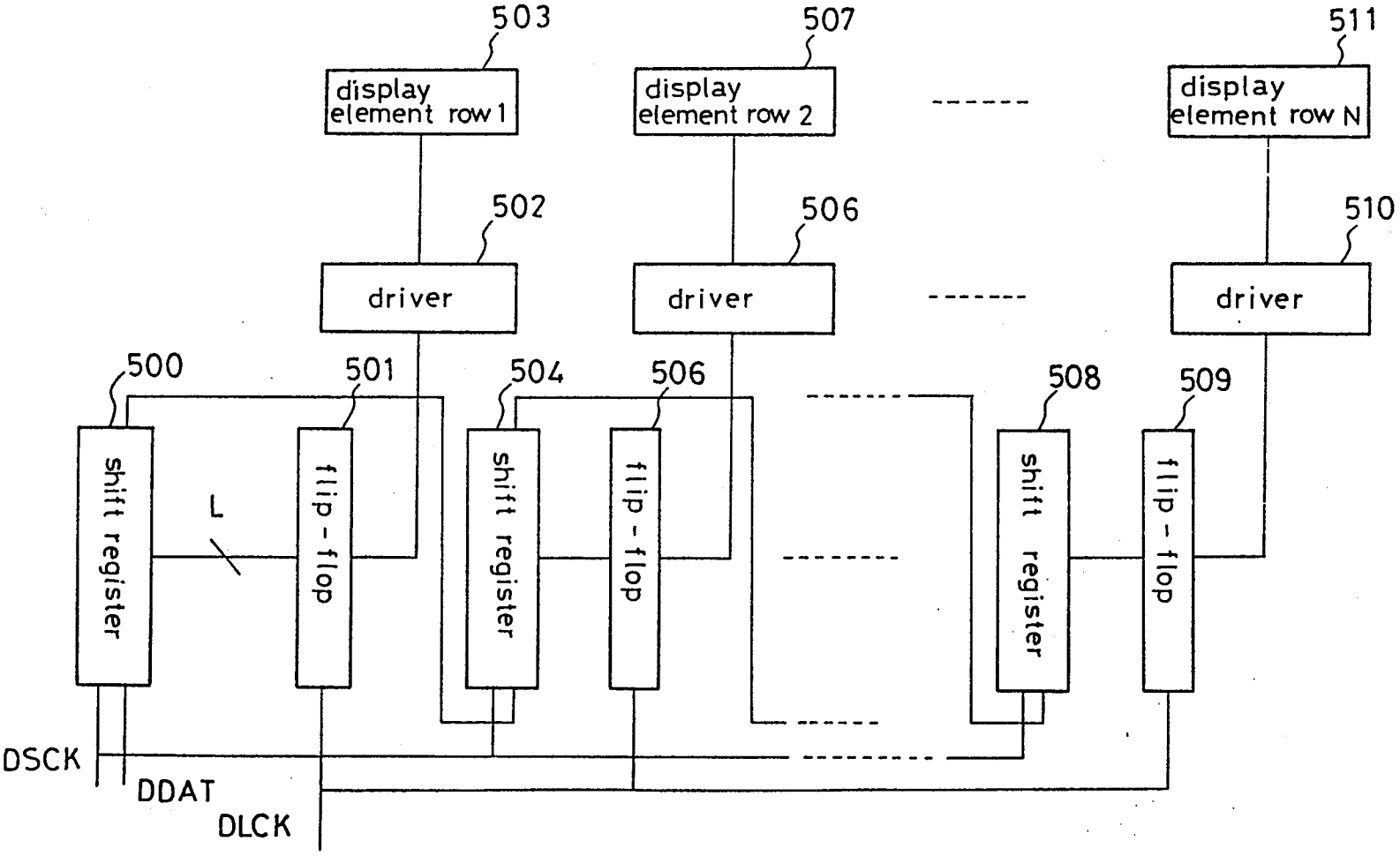
FIG. 18 is a block diagram illustrating another example of the circuit structure of the display zone of the fifth embodiment.

FIG. 18 is a block diagram illustrating another embodiment of the display zone.

Some standard IC comprises a shift register and a flip-flop. If s sweet-potato vein-like structure including such shift registers is adopted, the wiring line quantity can be reduced and expansion can be easily accomplished. By putting the output of shift register 500 directly into shift register 504 of the adjacent row, the distance between adjacent rows is expanded while adopting the same circuit structure in respective rows. If latch clock DLCK is stopped according to need, a plurality of display arrays act as an apparatus displaying a stationary picture. Accordingly, the apparatus can be used as a display apparatus for guidance and escape of passengers in case of emergency, for example, in an accident.

In the foregoing embodiments, the display apparatus is fixed. However, the display can be similarly performed even if the display apparatus is moved. An embodiment of the display apparatus of this type will now be described.

Figure 19:
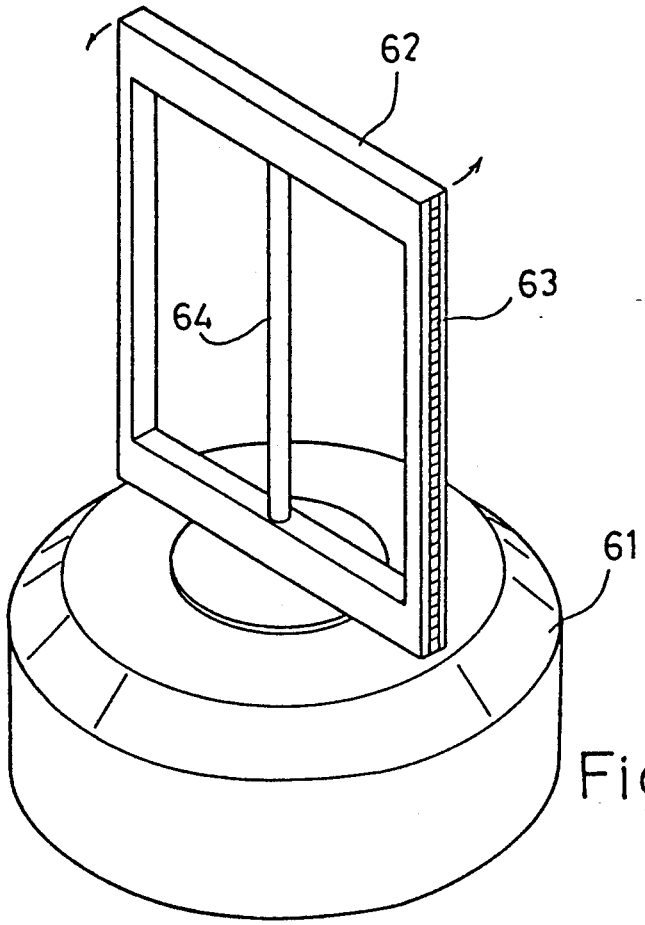
FIG. 19 is a perspective view of an embodiment of the present invention, in which a display apparatus having a movable structure is arranged.

Referring to FIG. 19, a rotatory moving display portion 62 is projected from a pedestal 61, and a display element array 63 is attached to the moving display portion 62. The arrangement direction of the display element array 63 is in parallel to the axial direction of a rotation shaft 64, and the display plane becomes a cylindrical plane by rotation.

Figure 20:
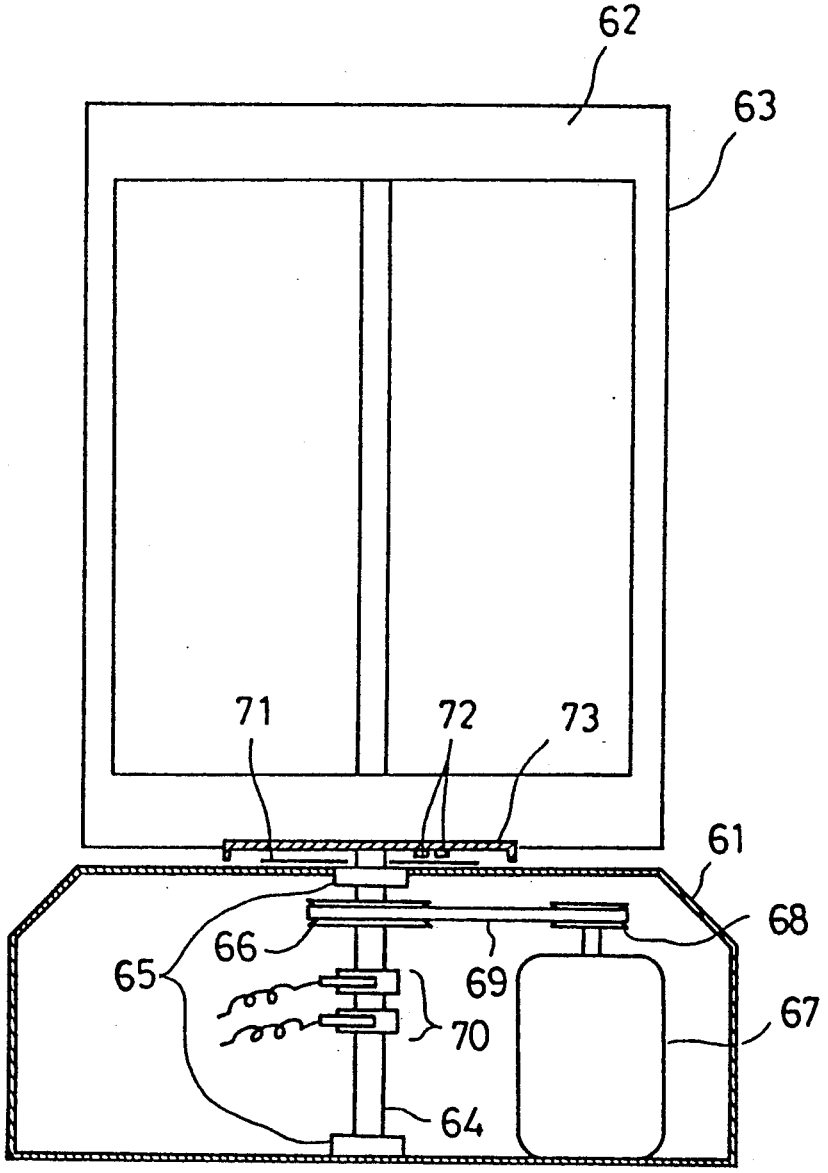
FIG. 20 is a diagram illustrating the structure of the interior of a pedestal portion of the above-mentioned display apparatus.

The internal structure of the pedestal is illustrated in FIG. 20. The moving display portion 62 is supported by the rotation shaft 64, and the rotation shaft 64 is rotatably supported on the pedestal 61 by a bearing 65. A driven pulley 66 is attached to the rotation shaft 64, and a belt 69 is hung between the driven pulley 66 and a driver pulley 68 attached to a shaft of a motor 67 secured to the pedestal 61. A slip ring 70 is attached to the rotation shaft 64 so that an electric power is supplied to the moving display portion 62 from the pedestal portion. An encoder disk 71 of the reflection type is attached above the pedestal 61, and an encoder sensor 72 including a reflection type optical sensor is attached below the rotatory moving portion. The encoder sensor 72 comprises a Z sensor 72A generating only the output of the starting point and an A sensor 72B emitting the rotation angle. The pattern of the encoder disk 71 corresponds to that of the encoder sensor 72. A light-shielding cover 73 covering the encoder disk is attached in the lower portion of the moving display portion.

Figure 21:
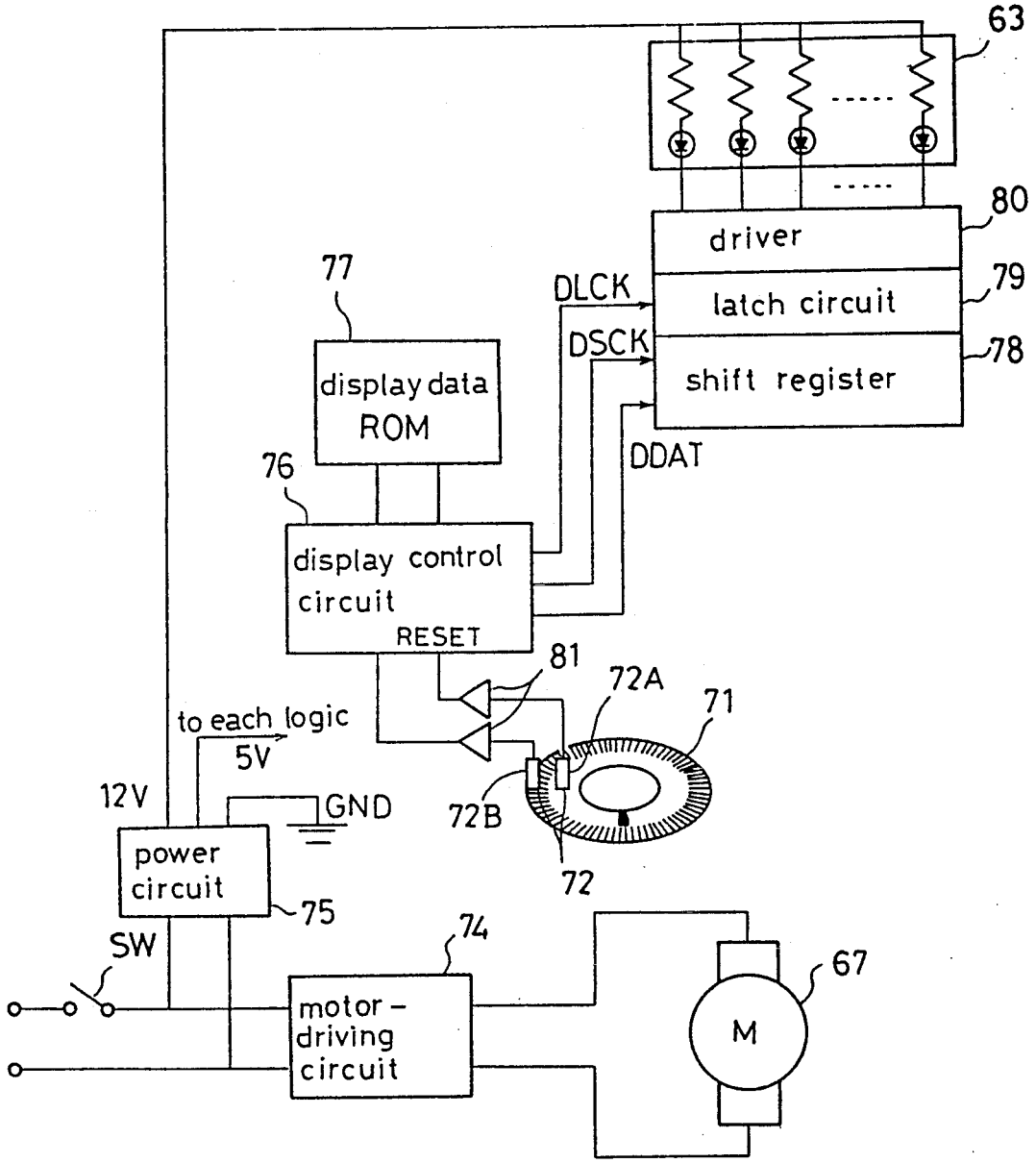
FIG. 21 is a block diagram illustrating the circuit structure of the above-mentioned display apparatus.

FIG. 21 is a circuit diagram of the present embodiment. The electric power put in from the terminal of the power source by the turn-on operation of a power switch SW is fed to a motordriving circuit 74 and a power source circuit 75. The motor-driving circuit 74 is connected to the motor 67. A display control circuit 76 is connected to ROM 77 for the storage of display data, a shift register 78 and a circuit 81 for the waveform processing of the encoder signal. A parallel output of the shift register 78 is put into a latch circuit 79 and the output of the latch circuit 79 is put into a driver 80. The output of the driver 80 is connected to the display element array 63. The encoder sensor 72 is connected to the circuit 81 for the waveform processing of the encoder signal.

The operation of this circuit will now be described.

When the power switch SW is closed, the motor 67 is rotated to drive the moving display portion 62 through the driver pulley 68, belt 69, driven pulley 66 and rotation shaft 64, and a signal is generated from the encoder sensor 72. When a starting point detection signal from the Z sensor 72A is put into RESET terminal of the display control circuit 76, ROM address pointer in the display control circuit 76 indicates the first row of display data. When a rotation angle signal from the A sensor 72B is put in, data of the first row from ROM 77 storing display data therein are put in and fed out to the shift register 78. When the feed-out of data of one row is completed, the display control circuit 76 advances the address by one row and emits a latch signal to the latch circuit 79 to emit the output of the shift register 78 as the latch output. One-dimensional data corresponding to the latch output are displayed on display elements. This operation cycle is repeated every time the rotation angle signal from the A sensor 72B of the encoder sensor 72 is received, and therefore, display data are changed momentarily according to the rotation position to effect a two-dimensional display.

The deviation of the display position is prevented by a rotary encoder corresponding to the rotation position and the display is made precisely at the predetermined position. When a pulse motor is used as the motor, the deviation of the position can be prevented by making a pulse motor-driving pulse synchronous with a data-displaying timing, even if the encoder is not used. Furthermore, there can be adopted a method in which the motor is driven at a constant speed and a display timing signal is produced by dividing the clock. The electric connection between the rotatory portion and fixed portion is effected in the pedestal 61 by the slip ring as shown in FIG. 19. This method is advantageous in that the electric power is supplied only through two contacts. In this case, even the display control circuit 76, ROM 77, encoder signal waveform processing circuit 81, shift register 78, latch circuit 79 and driver 80 should be attached to the moving portion, but the above-mentioned circuit utilizing the semiconductor technique has a very light weight and a small size and can be practically realized.

In the present embodiment, display data can be changed only by exchanging ROM 77 for the storage of display data. Furthermore, the above-mentioned ROM can be changed to reloadable ROM or RAM such as EEPROM and data can be changed by an external machine. After a certain time from the point of scanning, subsequent display can be made. Alternately, the display portion can be continuously rotated. The timing of the output of picture plane data started by the start trigger by the signal from the Z sensor 72A is set in the same manner as the timing of FIG. 9 illustrated hereinbefore with respect to the first embodiment. Therefore, explanation of this output timing is omitted.

If this display apparatus is used, a peculiar impression can be given by an optical letter or image floating in space, and an advertising effect attracting the attention of passersby is increased. Furthermore, the portion beyond the display can be seen through the display, and therefore, a commodity or the like can be placed beyond the display and composite exhibition becomes possible. This is another characteristic advantage of the present invention.

Figure 22:
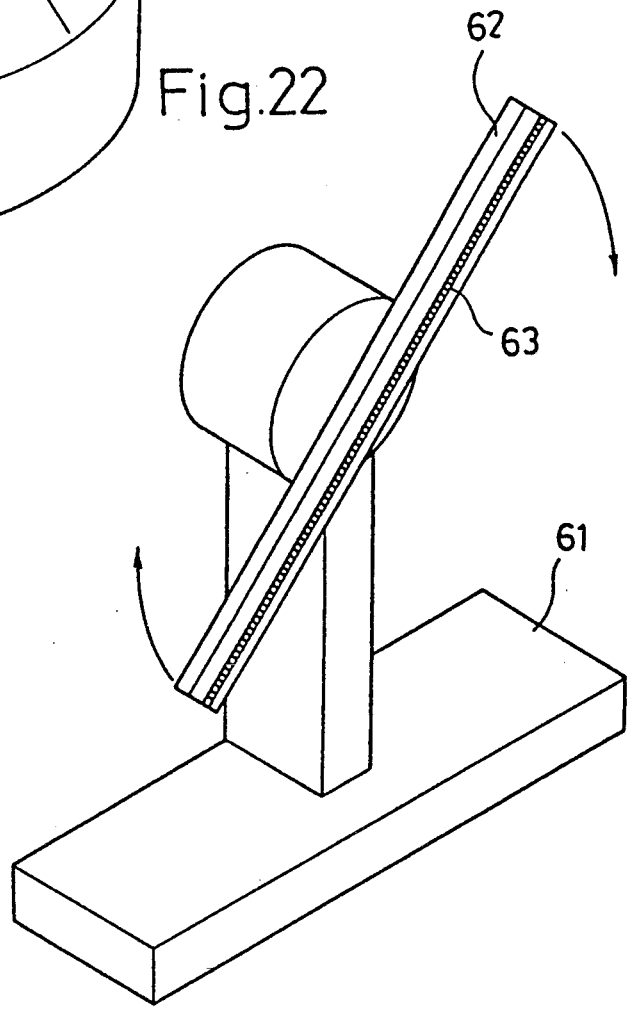
FIG. 22 is a perspective view illustrating another embodiment of the present invention.

Still another embodiment is illustrated in FIG. 22.

In this embodiment, the moving display portion 62 is constructed so that the moving display portion 62 rotates around the horizontal axis of the pedestal 61, and the display plane has a disc-like shape. In this embodiment, letters and images to be displayed are of the polar coordinate system. The circuit structure is substantially the same as that of the foregoing embodiments, and explanation is omitted. However, since the moving speed is different between the center and the periphery, in order to maintain the same display brightness between the periphery and the center, it is necessary that the brightness should be changed among the display elements.

Figure 23:
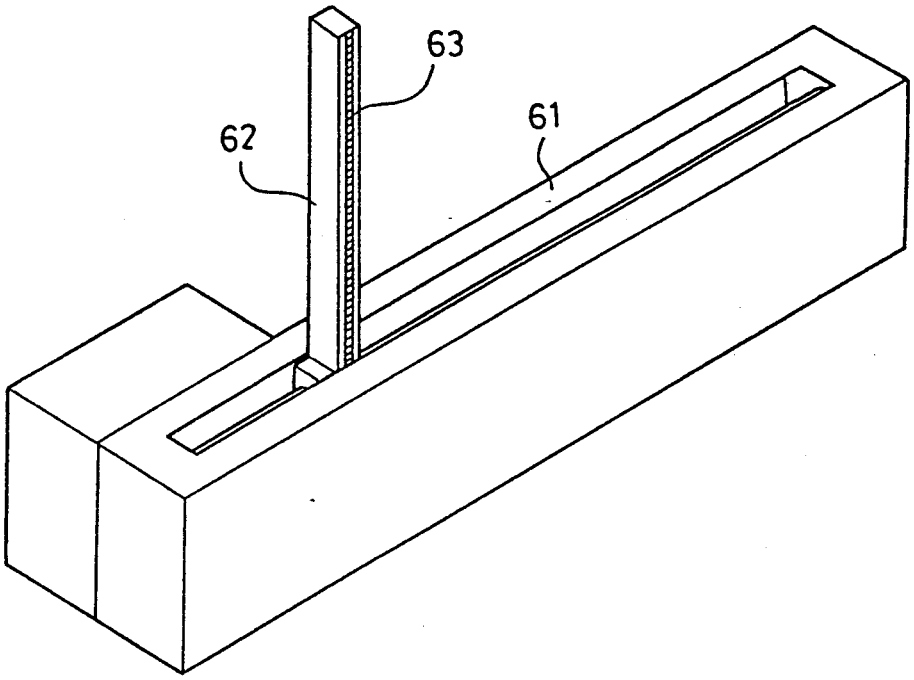
FIG. 23 is a perspective view illustrating still another embodiment of the present invention.

FIG. 23 shows still another embodiment in which a rod-shaped moving display portion 62 is projected from the pedestal 61 and is advanced laterally. In this case, the display plane has a tetragonal shape (rectangular shape or parallelogrammic shape).

Figure 24:
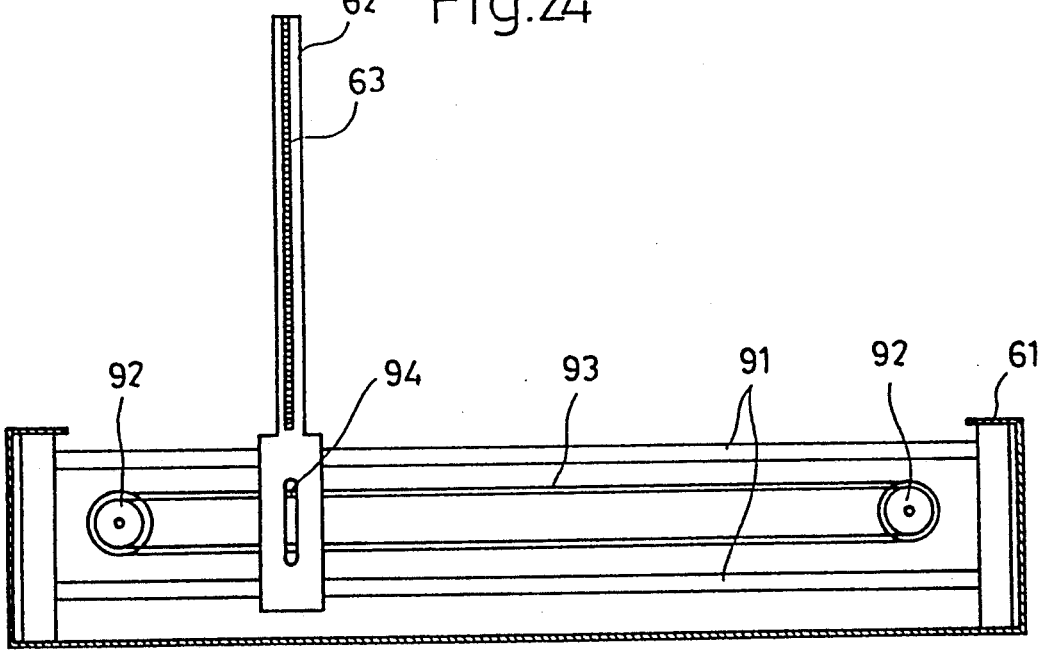
FIG. 24 is a diagram illustrating the structure of the interior of a pedestal portion of the embodiment shown in FIG. 23.

FIG. 24 is a diagram illustrating the moving structure of the moving display portion 62 of the embodiment shown in FIG. 23.

A slide shaft 91 is fixed in the interior of the pedestal 61, and a sliding part (not shown) is attached to this slide shaft 91 and the moving display portion 62 is attached to the sliding part. A pair of gears 92 to be driven by a prime mover (not shown) are arranged within the pedestal 61, and a chain 93 is hung on the gears 92. One of connecting pins 94 of the chain 93 is projected and fitted in a groove formed at the lower part of the moving display portion 62 to drive the moving display portion 62. The illustrated moving mechanism is only an example, and other structures can be adopted.

The circuit structure is substantially the same as in the foregoing embodiments. However, since a reciprocating motion is performed, a slip ring need not be disposed. Furthermore, needless to say, the encoder for the detection of the display position is a linear encoder.

As is apparent from the foregoing description, according to the present invention, by the relative movement of the $(n-1)$-dimensional display apparatus and the moving member for the observation, n-dimensional display of images is effected by utilizing the after-image effect of eyes. Therefore, displayed images can be recognized by an observer even from a vehicle moving at a high speed without moving his neck. Accordingly, even at a position where the conventional display apparatus cannot be arranged because the space between the wall surface and the observer is too narrow, for example, at a position in a subway or a tunnel, the display apparatus of the present invention can be arranged. Moreover, an image display having an optional size can be obtained according to the moving speed of the moving member and the changeover speed of the image display data. Still further, since the number of display elements can be drastically reduced, the installation space can be reduced and the present invention is advantageous from the economical viewpoint.

Moreover, in the structure when the display apparatus is moved, displayed letters or images are seen floating in space, and a peculiar impression is given to passersby and an advertising effect attracting the attention of passersby is enhanced. Furthermore, since the portion beyond the display can be seen through the display, if a commodity or the like is placed beyond the display, composite exhibition can be made. Also in this case, the number of display element and the installation space can be reduced.

Industrial Applicability

As is apparent from the foregoing description, the n-dimensional scanning type display method and apparatus of the present invention can be disposed even in a subway or tunnel where the conventional image display system cannot be disposed, and therefore, a very high practical effect can be attained as an advertising display apparatus or the like.

What is claimed is:

1. An n-dimensional scanning type display apparatus being at least one of: a two dimensional display apparatus and a three dimensional display apparatus, said apparatus having:

a display zone provided an $n-1(n=2,3)$-dimensional display array zone for obtaining an n-dimensional image by accomplishing an image scanning operation in a direction of the display based on a display changeover operation of said display array zone and the moving of a moving member for having an observer thereon, said display apparatus comprising means in a sensor zone for detecting the passage of the moving member past a reference position and outputting movement information including moving speed information, and means for indicating moving direction, a data-forming zone forming a display changeover control signal based on the movement information from the sensor zone and said means for indicating moving direction, said data-forming zone outputting display data, and said display zone having an $(n-1)$-dimensional display area zone fixedly arranged along a path of the moving member, and said display zone constructed by many emission elements, said display zone arranged for receiving display data based on the display changeover control signal from the data-forming zone and changing over and displaying $(n-1)$-dimensional images in a succession of images, said succession of images operatively being responsive to at least one of the moving speed information and the moving direction information and generating moving signal information for moving said images, in a succession, along with the moving member along said path.

2. An n-dimensional scanning type display apparatus according to claim 1, wherein a plurality of said display zones are arranged at predetermined intervals along the moving direction of the moving member in parallel to one another.

3. An n-dimensional scanning type display apparatus according to claim 1, wherein the sensor zone comprises a sensor circuit for detecting the moving member and said means for indicating moving direction; and said means for indicating moving direction being for indicating the moving direction of the moving member based on a detection signal from the sensor circuit and outputting moving direction information into the data-forming zone.

4. An n-dimensional scanning type display apparatus according to claim 3, wherein the sensor zone comprises a sensor circuit including first and second sensors arranged at a predetermined interval along the moving direction of the moving member and a judging portion for judging which of the two sensors first detects the moving member, thus judging the moving direction of the moving member and outputting a moving direction information into the data-forming zone.

5. An n-dimensional scanning type display apparatus according to claim 1, wherein the sensor zone comprises:

a sensor circuit for detecting the moving member; and a judging portion for;

judging the moving speed of the moving member based on a detection signal from the signal circuit; and outputting moving speed information into the data-forming zone.

6. An n-dimensional scanning type display apparatus according to claim 5, wherein the sensor zone comprises:

said sensor circuit including first and second sensors arranged at predetermined intervals along the moving direction of the moving member; and said judging portion being for:

measuring the difference of the detection time between both of the sensors, computing the moving speed of the moving member based on the measured value, and outputting moving speed information into the data-forming zone.

7. An n-dimensional scanning type display apparatus according to claim 1, wherein:

the data-forming zone comprises controls signal-generating means for generating various display changeover control signals based on moving information from the sensor zone including at least one of the moving speed information and the moving direction information of the moving member, and memory means for storing image display data therein and outputting display data based on an address signal generated in the control signal-generating means, and generating the moving signal information for moving said images, in a succession, along with the moving member along said path, and parallel-serial conversion means for converting parallel display data output from the memory means to serial display data and transferring the serial display data based on a data transfer signal from the control signal generating means.

8. An n-dimensional scanning type display apparatus according to claim 7, wherein:

the control signal-generating means comprises a latch circuit for latching the moving information of the moving member from the sensor zone, and a programmable oscillator for generating a clock signal of a predetermined frequency based on the moving information latched at the latch circuit, and an address signal-generating circuit for generating an address signal to the memory portion based on the oscillating clock of the programmable oscillator, and a data input control signal-generating circuit for generating a display data input control signal to the parallel-serial conversion means based on the oscillating clock of the programmable oscillator, and a display drive control signal-generating circuit for generating a display drive control signal to a display zone based on the oscillating clock of the programmable oscillator.

9. An n-dimensional scanning type display apparatus according to claim 1, wherein the display zone comprises:

serial-parallel conversion means for receiving serial data transferred from parallel-serial conversion means based on the data input control signal from the data-forming zone and converting the received serial data to parallel data, display drive means for latching parallel display data of the serial-parallel conversion means based on a data latch signal from the data forming zone, and a display array portion driven by the display drive means to display said latched display data.

10. An n-dimensional scanning type display apparatus according to claim 9, wherein the display zone comprises a plurality of display units connected to one another, each display unit comprising said serial-parallel conversion means, said display drive means and said display array portion.

11. An n-dimensional scanning type display apparatus according to claim 9, wherein each display element of the display array portion comprises at least one LED.

12. An n-dimensional scanning type display apparatus according to claim 11, wherein said at least one LED comprises at least a red (R) emission element and a green (G) emission element.

13. An n-dimensional scanning type display apparatus according to claim 11, wherein each picture element of the display array portion comprises one LED.

14. An n-dimensional scanning type display apparatus according to claim 11, wherein each picture element of the display array portion comprises a plurality of LED's.

15. An n-dimensional scanning type display apparatus according to claim 9, wherein each display unit comprises said serial-parallel conversion means, said display drive means and said display array portion for each of a red (R) emission element and a green (G) emission element.

16. An n-dimensional scanning type display apparatus according to claim 1, wherein the display array portion of the display zone comprises a plurality of display array rows, the number of which is smaller than the number of display picture elements arranged along said moving direction to effect display along with the movement of the moving member.

17. An n-dimensional scanning type display apparatus according to claim 16, wherein a display data-storing portion and a display array-driving portion are disposed in each array row.

18. An n-dimensional scanning type display apparatus according to claim 17, wherein display data of the display data-storing portion of each display array row are input to the display data-storing portion of the adjacent display array row in succession.

19. An n-dimensional scanning type display apparatus being at least one of a two-dimensional display apparatus and a three-dimensional display apparatus, said apparatus comprising:

a sensor zone, a data-forming zone and a display zone;

said sensor zone comprising means for detecting passage of a moving observer past a reference position and outputting movement information, the movement information including moving speed information;

means for indicating moving direction;

said data-forming zone comprising:

means for producing a display changeover control signal based on the movement information from said sensor zone and said means for indicating moving direction; and means for outputting display data;

said display zone provided an $n-1(n=2,3)$-dimensional display array zone for displaying an n-dimensional image by accomplishing an image scanning operation in a direction of the display based on a display changeover operation of said display array zone and the movement of the moving observer; and said display zone comprising:

an $(n-1)$-dimensional display area zone being fixedly disposed along a path of the moving observer;

a plurality of emission elements;

means for receiving display data based on the display changeover control signal from said data-forming zone;

means for changing over and displaying $(n-1)$-dimensional images in a succession of images, the succession of images being operatively responsive to at least one of the moving speed information and the moving direction information; and means for generating moving signal information for moving said images, in a succession, along with the moving observer along said path.

20. An n-dimensional scanning type display apparatus according to claim 19, wherein a plurality of said display zones are arranged at predetermined intervals along the moving direction of the moving observer in parallel to one another.

21. An n-dimensional scanning type display apparatus according to claim 19, wherein the sensor zone comprises a sensor circuit for detecting the moving observer and said means for indicating moving direction;

said means for indicating moving direction being for indicating the moving direction of the moving observer based on a detection signal from the sensor circuit and outputting moving direction information into the data-forming zone; and the sensor zone comprising a sensor circuit including first and second sensors arranged at a predetermined interval along the moving direction of the moving observer and a judging portion for judging which of the two sensors first detects the moving observer, thus judging the moving direction of the moving observer and outputting a moving direction information into the data-forming zone.

22. An n-dimensional scanning type display apparatus according to claim 19, wherein the sensor zone comprises:

a sensor circuit for detecting the moving observer;

a judging portion for;

judging the moving speed of the moving observer based on a detection signal from the sensor circuit; and outputting moving speed information into the data-forming zone;

said sensor circuit including first and second sensors arranged at predetermined intervals along the moving direction of the moving observer; and said judging portion being for:

measuring the difference of the detection time between both of the sensors, computing the moving speed of the moving observer based on the measured value, and outputting moving speed information into the data-forming zone.

23. An n-dimensional scanning type display apparatus according to claim 19, wherein:

the data-forming zone comprises control signal-generating means for generating various display changeover control signals based on moving information from the sensor zone including at least one of the moving speed information and the moving direction information of the moving observer, memory means for storing image display data therein and outputting display data based on an address signal generated in the control signal-generating means, and generating the moving signal information for moving said images, in a succession, along with the moving observer along said path, parallel-serial conversion means for converting parallel display data output from the memory means to serial display data and transferring the serial display data based on a data transfer signal from the control signal generating means, the control signal-generating means comprises a latch circuit for latching the moving information of the moving observer from the sensor zone, a programmable oscillator for generating a clock signal of a predetermined frequency based on the moving information latched at the latch circuit, an address signal-generating circuit for generating an address signal to the memory portion based on the oscillating clock of the programmable oscillator, and a data input control signal-generating circuit for generating a display data input control signal to the parallel-serial conversion means based on the oscillating clock of the programmable oscillator, and a display drive control signal-generating circuit for generating a display drive control signal to a display zone based on the oscillating clock of the programmable oscillator.

24. An n-dimensional scanning type display apparatus according to claim 19, wherein the display zone comprises:

serial-parallel conversion means for receiving serial data transferred from parallel-serial conversion means based on the data input control signal from the data-forming zone and converting the received serial data to parallel data, display drive means for latching parallel display data of the serial-parallel conversion means based on a data latch signal from the data forming zone, and a display array portion driven by the display drive means to display said latched display data.

25. An n-dimensional scanning type display apparatus according to claim 24, wherein the display zone comprises a plurality of display units connected to one another, each display unit comprising said serial-parallel conversion means, said display drive means and said display array portion.

26. An n-dimensional scanning type display apparatus according to claim 24, wherein each display element of the display array portion comprises at least one LED.

27. An n-dimensional scanning type display apparatus according to claim 26, wherein said at least one LED comprises at least a red (R) emission element and a green (G) emission element.

28. An n-dimensional scanning type display apparatus according to claim 26, wherein each picture element of the display array portion comprises one LED.

29. An n-dimensional scanning type display apparatus according to claim 26, wherein each picture element of the display array portion comprises a plurality of LED's.

30. An n-dimensional scanning type display apparatus according to claim 24, wherein each display unit comprises said serial-parallel conversion means, said display drive means and said display array portion for each of a red (R) emission element and a green (G) emission element.

31. An n-dimensional scanning type display apparatus according to claim 19, wherein the display array portion of the display zone comprises a plurality of display array rows, the number of which is smaller than the number of display picture elements arranged along said moving direction to effect display along with the movement of the moving observer.

32. An n-dimensional scanning type display apparatus according to claim 31, wherein:

a display data-storing portion and a display array-driving portion are disposed in each array row; and display data of the display data-storing portion of each display array row are input to the display data-storing portion of the adjacent display array row in succession.

* * * * *

UNITED STATES PATENT AND TRADEMARK OFFICE

CERTIFICATE OF CORRECTION

PATENT NO. : 5,202,675

DATED : April 13, 1993

INVENTOR(S) : Toyotaro Tokimoto, et al.

It is certified that error appears in the above-indentified patent and that said Letters Patent is hereby corrected as shown below:

In column 4, line 36, after 'point' delete "a" and insert --a--.

In column 4, line 38, after 'point' delete "b" and insert --b--.

In column 5, line 10, after 'of' delete "l>L" and insert --ℓ>>L--.

In column 5, line 11, after 'distance' delete "l" and insert --ℓ--.

In column 5, line 16, after '=' delete "l/v" and insert --ℓ/v --.

In column 5, line 17, after the second occurrence of '=' delete "l/" and insert --ℓ/--.

In column 5, line 19, after 'by' delete "l/s" and insert --ℓ/s--.

In column 5, line 24, after 'time' delete "l/" and insert --ℓ/--.

In column 7, line 31, after 'of' delete "$X_o$" and insert --$x_o$--.

In column 7, line 32, after 'of' delete "$n_m$" and insert --$h_m$--.

UNITED STATES PATENT AND TRADEMARK OFFICE

CERTIFICATE OF CORRECTION

PATENT NO. : 5,202,675

DATED : April 13, 1993

INVENTOR(S) : Toyotaro TOKIMOTO and Hiroshi YAJIMA

It is certified that error appears in the above-indentified patent and that said Letters Patent is hereby corrected as shown below:

In column 7, line 38, after '(' delete "$x_0$" and insert --$x_o$--.

In column 7, line 63, after 'detected' delete "beyond" and insert --(beyond--.

In column 8, line 1, after '=' delete "2" and insert --2'--.

In column 8, line 35, after 'μsec' insert --=--.

In column 10, line 11, after 'FIG.' insert --12,--.

In column 10, line 16, after 'FIGS.' delete "13(a-(d)" and insert --13 (a)-(d)--.

In column 10, line 68, after '31,' delete "34, 37" and insert --34, ... 37--.

In column 16, line 41, Claim 7, after 'comprises' delete "controls" and insert --control--

Signed and Sealed this

Fifth Day of November, 1996

Bruce Lehman

*Attest:*

BRUCE LEHMAN

*Attesting Officer*

*Commissioner of Patents and Trademarks*